US008162180B2

(12) United States Patent
Lips

(10) Patent No.: US 8,162,180 B2
(45) Date of Patent: Apr. 24, 2012

(54) CONTAINER FOR TRANSPORTING AND DISPENSING LIQUIDS

(76) Inventor: Jon S. Lips, Parker, CO (US)

( * ) Notice: Subject to any disclaimer, the term of this patent is extended or adjusted under 35 U.S.C. 154(b) by 1049 days.

(21) Appl. No.: 11/935,213

(22) Filed: Nov. 5, 2007

(65) Prior Publication Data

US 2008/0083777 A1 Apr. 10, 2008

Related U.S. Application Data

(63) Continuation-in-part of application No. 11/835,253, filed on Aug. 7, 2007.

(60) Provisional application No. 60/836,480, filed on Aug. 8, 2006.

(51) Int. Cl.
*B65D 35/56* (2006.01)

(52) U.S. Cl. ... 222/105; 222/183; 222/570; 229/117.27; 229/117.35; 220/495.06

(58) Field of Classification Search ..... 222/105, 222/183, 527, 107, 566–568, 94–95, 570; 229/117.27, 117.35, 117.15; 383/906; 220/495.01, 220/495.05, 495.06
See application file for complete search history.

(56) References Cited

U.S. PATENT DOCUMENTS 3,087,655 A 4/1963 Scholle
3,160,326 A 12/1964 Sturdevant et al.
3,170,601 A 2/1965 Daley
3,171,573 A 3/1965 Berney
3,233,817 A 2/1966 Casady
3,329,316 A 7/1967 Lowe
3,331,533 A 7/1967 Krugger
3,349,960 A 10/1967 Ketler
3,765,574 A 10/1973 Urquiza
3,937,363 A 2/1976 Anderson
4,154,367 A 5/1979 Hanson et al.
4,174,051 A 11/1979 Edwards et al.
4,223,810 A 9/1980 Sneider
4,241,856 A * 12/1980 Otterson ..... 222/539
4,416,396 A 11/1983 Ward
4,426,027 A 1/1984 Maynard, Jr.
4,520,948 A 6/1985 Hampel et al.
5,085,346 A 2/1992 Wright
5,176,313 A 1/1993 Curry et al.
5,195,661 A 3/1993 Light
6,223,981 B1 * 5/2001 Gunder ..... 229/242
6,290,124 B2 9/2001 Andrews, Sr. et al.
7,344,052 B2 * 3/2008 Light ..... 222/105
2006/0091154 A1 5/2006 Light

* cited by examiner

*Primary Examiner* — Frederick C. Nicolas

(57) ABSTRACT

A collapsible container for storing, transporting, and dispensing liquids which includes a generally rectangular shaped box, a spout which is fluidly interconnected to the box, a pouring spout member which is attachable to the spout, a handle, and a support member which maintains the position of the spout relative to the box. The pouring spout member may form a non-releasable connection with the spout to allow for single use of the container. The container may be configured such that, when viewed in lateral cross section and when viewed in longitudinal cross section, the container includes a continuous band of material surrounding the interior volume of the container that is maintained during storage, expansion, and use.

11 Claims, 26 Drawing Sheets

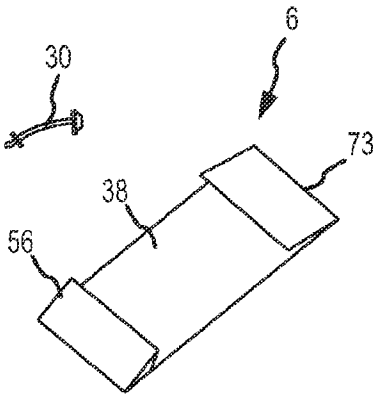
FIG.15A
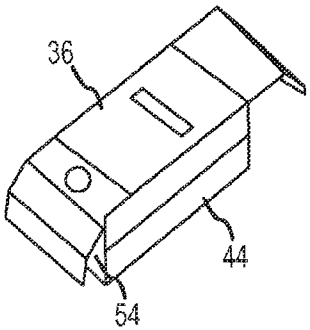
FIG.15B
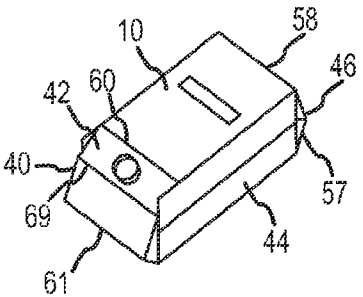
FIG.15C
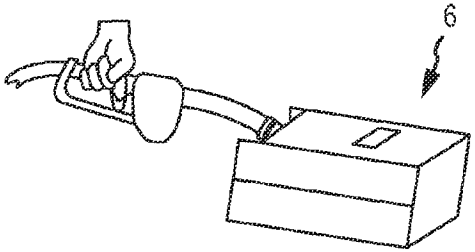
FIG.15D
FIG.15E
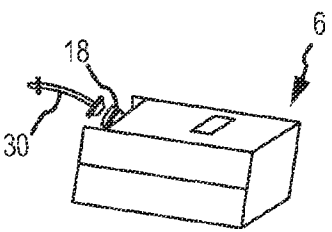
FIG.15F

CONTAINER FOR TRANSPORTING AND DISPENSING LIQUIDS

RELATED APPLICATIONS

This application is a continuation-in-part of pending U.S. patent application Ser. No. 11/835,253, filed Aug. 7, 2007, entitled "Container For Transporting And Dispensing Liquids," which is incorporated by reference in its entirety herein and claims priority from U.S. Provisional Patent Application Ser. No. 60/836,480, filed Aug. 8, 2006, entitled "Container For Transporting And Dispensing Liquids," which is also incorporated by reference in its entirety herein.

FIELD OF THE INVENTION

The invention described herein generally relates to containers for storing liquids. More specifically, described embodiments relate to low-cost containers for storing, transporting, and dispensing a flammable liquid.

BACKGROUND OF THE INVENTION

Containers for storing and transporting various liquids are well known in the art. There are a number of variations in the shapes, sizes, construction, and features of such containers. For example, portable containers of metal or plastic having cylindrical or box-like shapes are commonplace in many households. Typically these containers have a housing for storing a liquid, an opening for filling and emptying a liquid, and often some type of handle for carrying the container.

Containers such as those described above are prevalent in automobiles and garages throughout the country. However, it has been recognized that these containers, when used to store certain fluids (e.g., volatile fluids, fuel, and gasoline), can pose a potential hazard due to harmful air emissions being discharged when the containers are stored for extended periods of time in a filled condition. Many states have created strict standards for portable fuel containers, which have made them relatively expensive. Motorists stranded on the road often need a container to transport fuel from the pump to the vehicle. Approved one-time use containers (i.e., containers not intended to store fuel for extended periods of time in the filled condition) can provide a sensible, low-cost solution to stranded motorists. Additionally, since these containers are often stored in automobiles where space is limited, it is desirable that the containers have a compact, lightweight, and sturdy design.

SUMMARY OF THE INVENTION

In view of the foregoing, an objective of embodiments described herein is to provide for an improved liquid container and dispenser that is easily stored and assembled. It is another objective to provide a container that is designed for single use. It is yet another objective to provide a container that is capable of safely storing a flammable liquid. It is a further objective to provide a container for storing liquid that is compact, lightweight, and sturdy.

One aspect presented herein provides a container for use in filling, transporting, and dispensing a liquid including a housing, spout, pouring spout member, neck support member, and a handle. The container may include an outer shell, formed from a blank sheet of cardboard having fold lines for folding the blank sheet into a generally rectangular-shaped box with top, bottom, side, front, and rear panels, and means for securing the panels to produce a rigid structure. An expandable bag may be enclosed inside the outer shell having a spout which extends through an opening in the front panel. Prior to dispensing a liquid, a pouring spout member may be secured to the spout to enable a user to easily pour a liquid into a receptacle, such as a gas tank of an automobile. The interconnection between the pouring spout member and the spout may be designed to include a locking mechanism, such that the interconnection is a non-releasable one. This feature may enable the container to perform as a single use container, which is desirable for the reasons stated above. A neck support member may be provided to maintain the position of the spout relative to the front panel during various stresses that are placed on the container during installation of the pouring spout member, and when filling, transporting, or dispensing a liquid.

In accordance with another aspect, the container may be in a collapsed form when it is sold. This provides for less expensive handling and shipping of the container. Additionally, the collapsed container may be stored easily in places where space is limited such as, for example, the trunk of an automobile.

Another aspect may provide a container for storing liquid that includes a neck support member positioned at the base of the spout in a face-to-face relationship with the front panel of the outer shell. A primary function of the neck support member is to retain the position of the spout relative to the housing during the installation of the pouring spout member onto the spout. The neck support member should generally provide enough support so that the position of the spout is maintained during various stresses on the container that may occur during the filling, spout installation, transporting, or emptying of a liquid. Additionally, the neck support member should be easily installable and relatively low cost.

In an embodiment, the spout and the neck support member may be configured so that the neck support member will pass axially over the spout only when the two are rotatably aligned with each other in a particular manner during installation.

In another embodiment, the spout may contain an exterior threading. Additionally, the neck support member may contain an interior threading that allows for threadably engaging the neck support member onto the spout during installation.

In yet another embodiment, the neck support member may have flexible tabs along its inner circumference. During installation, the neck support member may be pressed over the spout until the neck support member lies in a face-to-face relationship with the front panel of the outer shell. The flexible tabs may be shaped so as to permit the neck support member to move over a flange near the base of the spout when the neck support member is advanced in the direction of the container only, so that the neck support member is then in a secured position.

In another embodiment, the neck support member may be installable by placing it in a face-to-face relationship with the front panel of the outer shell and laterally advancing at least one of the neck support member and the spout toward each other. In this embodiment, the neck support member may have an opening for receiving at least a portion of the spout. The opening may be laterally advanced toward the spout during installation until an edge of the opening lies between the front panel of the outer shell and a flange of the spout. Furthermore, the opening may include a mouth portion and an internal portion, wherein during installation, the mouth portion receives the spout, and an edge of the internal portion is positioned between the front panel and the flange of the spout. The mouth portion of the opening may have a cross dimension which is within 15 percent of the maximum cross dimension of the base of the spout. For example, the cross dimension of the mouth section may be slightly smaller than the maximum cross dimension of the spout so that, when the neck support member is in an installed position, a force is exerted by the spout on the neck support member which maintains the position of the neck support member relative to the spout. The internal portion may be configured to encompass a portion of the spout, a majority of the spout, or the entire spout when in an installed position.

In yet another embodiment, the neck support member may be installable by pressing it axially over the spout and past a flange located near the base the spout. The neck support member may be configured to include a resilient beveled edge along its inner circumference, wherein the beveled edge has a minimum diameter that is smaller than the outer diameter of the flange. The beveled edge may be shaped such that its diameter is flexibly expanded when pressed over the flange in the direction of the container, and its diameter flexibly contracted when pressed against the flange in the direction away from the container. This design creates a locking mechanism which secures the location of the neck support member between the flange of the spout and the front panel of the outer shell of the container.

In another aspect, a container for storing liquid is provided. The container may include a housing, a spout interconnected to the housing, and a support member. The spout may include a first flange and a second flange. At least a portion of the support member may be disposed between the housing and the second flange, and at least a portion of the support member may be disposed between the first and second flanges.

In an embodiment, the spout may be disposed within an opening in the housing, wherein a minimum cross dimension of the opening is less than a minimum cross dimension of the first flange. A minimum cross dimension of the opening may be greater than a maximum cross dimension of the second flange. The support member may include an internal edge portion, wherein the support member is configured such that at least a portion of the internal edge portion lies between the second flange and the housing. The support member may be configured such that the internal edge portion encompasses a majority of the spout. The support member may be configured such that the internal edge portion encompasses an entirety of the spout.

In another embodiment, the housing may further include an outer shell and an expandable bag located inside of the outer shell, where the expandable bag is fluidly interconnected to the spout. The expandable bag may include a dual-layered liner comprising an inner liner comprising a multi-polymer laminate and an outer liner comprising a nylon laminate. The inner liner may be fixedly attached to the outer liner. The outer shell may include a plurality of foldable panels configured to form a generally rectangular-shaped box.

In yet another embodiment, the housing may comprise cardboard. In an embodiment, the housing may be folded substantially flat and may be operable to be expanded to form a substantially rectangular shape.

In an arrangement, the support member may be installable by axial advancement of at least one of the support member and the housing toward each other. The support member may be installable by axial advancement of at least one of the support member and the spout toward each other.

The second flange may be circular-shaped and the support member may include a planar portion and a resilient member. The planar portion may be adjacent to the housing and have a circular-shaped opening. The opening may have a diameter which is larger than the diameter of the second flange. The resilient member may be positioned along the circumference of the circular-shaped opening. The resilient member may have an inner diameter that is smaller than the diameter of the second flange.

In still another aspect, a container for storing liquid is provided. The container includes an outer shell with a through hole, an expandable bag located inside the outer shell, and a spout fluidly interconnected to the expandable bag. The spout may include a first flange, a second flange, and a shoulder. The spout may extend through the through hole. The shoulder may correspond in size and shape with the through hole. The first flange may be adjacent to an inner surface of the outer shell. The second flange may be sized such that the second flange is operable to pass through the through hole. The first flange may be sized such that it is inoperable to pass through the through hole.

In an arrangement, the container may include a support collar at least partially disposed between an outer surface of the outer shell and a surface of the second flange facing the outer surface of the outer shell. In another embodiment, the support collar may be simultaneously engaged with the outer surface of the outer shell and the surface of the second flange facing the outer surface of the outer shell. The simultaneous engagement may restrict movement of the spout and the support collar relative to the outer shell.

In yet another aspect, a method for assembling a device for storing liquid is provided. The method may include providing a pre-cut sheet with a spout opening, inserting a spout into the spout opening, and folding and adhesively joining the pre-cut sheet. The folding and adhesively joining may be performed such that a top panel and a bottom panel of the pre-cut sheet are interconnected to each other through a pair of oppositely disposed side panels and a pair of oppositely disposed end panels. An expandable bag may be fluidly interconnected to the spout.

In an embodiment, the pre-cut sheet may be a cardboard sheet. In an embodiment, the side panels and the end panels may be free from direct interconnection to each other.

In an embodiment, the method may include installing a support collar over the spout after the inserting step such that the pre-cut sheet is sandwiched between the support collar and a flange of the spout. The installing step may comprise axially moving the support collar relative to the spout.

In another embodiment, the method may further comprise aligning a support collar with the spout opening prior to the inserting step. The inserting step may further comprise inserting the spout into the support collar. After the inserting step, the pre-cut sheet may be sandwiched between the support collar and a flange of the spout. The inserting step may comprise axially moving the spout relative to the support collar.

In still another embodiment, the inserting step may include holding the spout in a spout holder and automatically advancing at least one of the spout and the pre-cut sheet toward the other one of the spout and the pre-cut sheet. The folding and the adhesively joining steps may be completed in an automated manner.

In an arrangement, the folding and adhesively joining step may include folding a first portion of the bottom panel such that it comes into contact with a second portion of the bottom panel and adhesively joining the first portion of the bottom panel to the second portion of the bottom panel. The folding and adhesively joining step may further comprise folding the pre-cut sheet into a generally rectangular-shaped box. The method may further comprise flattening the device after the folding and adhesively joining step.

In another aspect, a method for assembling a device for storing liquid is provided. The method may include providing a collapsed fluid container. The provided collapsed fluid container may include a spout and an expandable bag fluidly interconnected to the spout. The collapsed fluid container may comprise a top panel and a bottom panel that are interconnected to each other through a pair of oppositely disposed side panels and a pair of oppositely disposed end panels. The method may further include expanding the collapsed fuel container and inserting a plurality of tabs into corresponding holes after the expanding step. The method may also include maintaining the interconnections of the top and bottom panels to each other through the pair of oppositely disposed side panels and the pair of oppositely disposed end panels during the expanding and inserting steps.

In an embodiment, the inserting step may comprise inserting four tabs into four corresponding holes wherein each tab is associated with a different corner of the device for storing liquid. The expanding step may include introducing pressurized air into the spout. The pressurized air may be produced by a user blowing into the spout. The method may also further comprise interconnecting a pouring spout member to the spout after the inserting step.

In another aspect, a collapsible container for storing liquid is provided that comprises an outer shell, a spout interconnected to the outer shell, and an expandable bag located inside of the outer shell. The expandable bag may be fluidly interconnected to the spout. The outer shell may include a top panel and a bottom panel, wherein the top panel and bottom panel are interconnected to each other by a pair of oppositely disposed side panels and a pair of oppositely disposed end panels. When the collapsible container is in a collapsed state, the pair of oppositely disposed side panels may not be directly connected to the pair of oppositely disposed end panels.

In another aspect, a collapsible container for storing liquid is provided that comprises an outer shell, a spout interconnected to the outer shell, and an expandable bag located inside of the outer shell. The expandable bag may be fluidly interconnected to the spout. The outer shell may include a top panel and a bottom panel. A first side panel may interconnect the top and bottom panels to each other. A second side panel may interconnect the top and bottom panels to each other. A first end panel may interconnect the top and bottom panels to each other. The first side panel may be oppositely disposed from the second side panel. The interconnections between the top panel and the bottom panel by the first and second side panels and the first end panel may be operable to be maintained during expansion of the collapsible container from a collapsed state to an expanded state.

In an embodiment, the collapsible container may further include a first support panel interconnected to one of the side panels or the first end panel. The first support panel may be operable to spring out relative to the panel to which it is connected when the collapsible container is expanded from the collapsed state. An interconnection member operable to interconnect the first support panel to another panel of the outer shell may be included. The interconnection member may be adhesively backed tape, hook and loop fasteners, glue patches placed on the first support panel or any other appropriate interconnection member.

The first support panel may be operable to connect to an oppositely disposed second support panel. For example, the first support panel may be connected to the end of a side panel and be operable to fold relative to the side panel and interconnect, via an interconnection member, to the second support panel connected to the other side panel. A plurality of support panels may be included. The support panels may be arranged in oppositely disposed pairs and may reinforce the corners of the collapsible container in an expanded state.

In a particular embodiment, the spout may be interconnected to the first end panel. A first support panel may be connected to the first side panel at an end of the first side panel opposite from the first end panel. In an arrangement of the current embodiment, a second support panel may be interconnected to one of the side panels at an end of the collapsible container opposite from the first support panel.

In another embodiment, the top panel and bottom panel may be interconnected to each other by a second end panel oppositely disposed from the first end panel. The spout may be interconnected to the first end panel. A first support panel may be connected to the first side panel at an end of the first side panel opposite from the first end panel, wherein a second support panel may be connected to the second side panel at an end of the second side panel opposite from the first end panel. The first and second support panels may be operable to be interconnected to each other after the collapsible container is expanded from the collapsed state. In an arrangement, a third support panel may be connected to the first side panel at an end of the first side panel proximate to the first end panel and a fourth support panel may be connected to the second side panel at an end of the second side panel proximate to the first end panel. The third and fourth support panels may be operable to be interconnected to each other after the collapsible container is expanded from the collapsed state.

In another aspect, a method for assembling a device for storing liquid is provided comprising providing a pre-cut sheet, inserting a spout into a spout opening, and folding and joining the pre-cut sheet after the inserting step such that a top panel and a bottom panel of the pre-cut sheet are interconnected to each other through a pair of oppositely disposed side panels and a pair of oppositely disposed end panels. The pre-cut sheet may include a spout opening and an expandable bag may be fluidly interconnected to the spout. The joining may include using adhesive to join portions of the pre-cut sheet.

In an embodiment of the present aspect, the method may further include flattening the device after the folding and joining step. The method may also include passing pressurized gas into the expandable bag after the folding and joining step and before the flattening step. This may be accomplished by passing air into the bag to expand the bag and the pre-cut sheet surrounding the bag. After the passing step and prior to the flattening step, the method may include folding a plurality of support panels connected to the side panels such that the plurality of support panels are parallel to at least one of the side panels. In this manner, the support panels may be tucked close to the side panels for subsequent collapsing of the device. The method may further comprise installing at least one securing member about the device in a flattened state, wherein the securing member at least partially prevents the flattened device from expanding. Shrink-wrap may be applied over the collapsed device and the securing members may be severed such that substantially the shrink-wrap alone keeps the device in a collapsed state.

In an embodiment, the side panels and the end panels may be free from direct connection with each other. In a particular embodiment, the method may include attaching a first portion of an adhesively backed member to a support panel connected to one of the side panels or one of the end panels, wherein a second portion of the adhesively backed member may be free from direct connection to the support panel. The adhesively backed member may be adhesive tape. The portion of the adhesive tape not attached to the support panel may include a removable backing. Any other appropriate securing member may be used in conjunction with or in place of the adhesive tape. In an embodiment, the interconnections between the top panel and the bottom panel through the pair of oppositely disposed side panels and the pair of oppositely disposed end panels may be permanent in that once attached during assembly, they may stay attached during the life cycle of the device (e.g., though dispending of liquids contained therein).

In still another aspect, a method for assembling a device for storing liquid is provided comprising a collapsed fluid container that includes side and end panels, expanding the collapsed fuel container, folding a support panel connected to one of the side panels or one of the end panels such that the support panel may be disposed adjacent to another one of the side panels or another one of the end panels, and securing an interconnection member attached to the support panel to another panel of the device for storing liquid. A spout may be interconnected to the collapsed fluid container. An expandable bag may be fluidly interconnected to the spout. A top panel and a bottom panel of the collapsed fluid container may be interconnected to each other through a pair of oppositely disposed side panels and a pair of oppositely disposed end panels.

In an embodiment where the collapsed fuel container is shrink-wrapped, a step of the method may include removing the shrink-wrap from a periphery of the collapsed fuel container prior to the expanding step. The removal of the shrink-wrap may result in the collapsed fluid container partially expanding. This may be due to the mechanical memory of the collapsed fluid container.

The folding step may be repeated for a plurality of different support panels. The method may include securing a plurality of interconnection members between support panels or between support panels and other panels of the device for storing liquid.

In an embodiment, as the collapsed fluid container is expanded, folded and the interconnection members are attached, the interconnections of the top and bottom panels to each other through the pair of oppositely disposed side panels and the pair of oppositely disposed end panels may be maintained.

In yet another aspect, a method for assembling a device for storing liquid is provided that includes inflating a bag disposed within an outer shell of the device to expand the device, collapsing the device after the inflating step, and packaging the device in a collapsed state after the collapsing step. In an embodiment, the packaging step may include shrink-wrapping the device.

In a particular embodiment of the present aspect, the packaging step may include installing a securing member about the device while the device is in a collapsed state prior to the shrink-wrapping. The securing member may at least partially prevent the collapsed device from expanding. After the shrink-wrapping, the securing member may be cut.

Numerous additional aspects and variances will be apparent to those skilled in the art upon consideration of the further description and drawings that follow. Furthermore, it will be noted that various combinations of the above-identified aspects and embodiments may be utilized.

BRIEF DESCRIPTION OF THE DRAWINGS

FIG. 15 illustrates the steps a user may take to operate an embodiment of the present invention.

DETAILED DESCRIPTION

Figure 1:
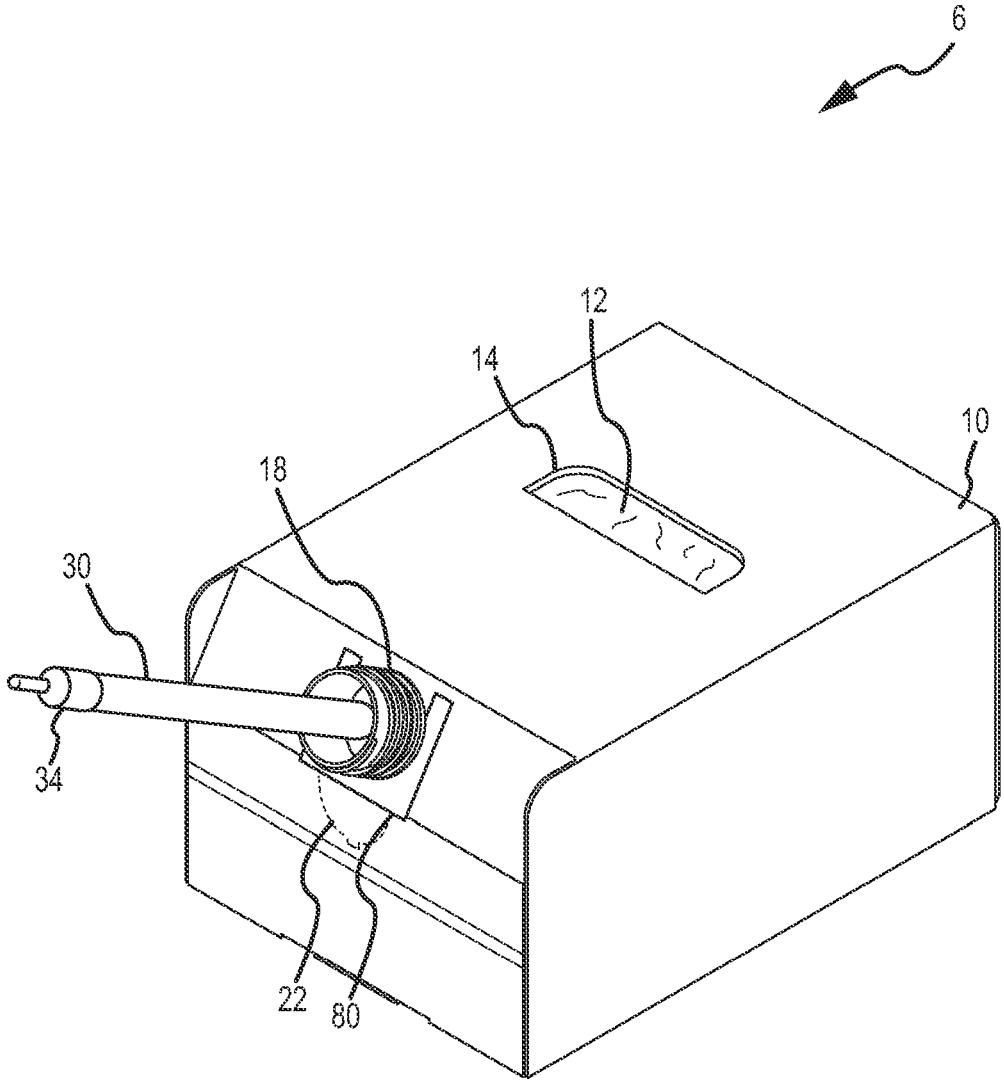
FIG. 1 illustrates a perspective view of an embodiment of the present invention.

While the invention is susceptible to various modifications and alternative forms, specific embodiments thereof have been shown by way of example in the drawings and are herein described in detail. It should be understood, however, that it is not intended to limit the invention to the particular form disclosed, but rather, the invention is to cover all modifications, equivalents, and alternatives falling within the scope of the invention as defined by the claims.

FIGS. 1-7 generally illustrate one embodiment of the present invention. FIG. 1 illustrates an assembled single use container 6 for storing a liquid. The container 6 includes an outer shell 10, an expandable bag 12, a handle 14, a spout 18, a neck support member 80, and a pouring spout member 30.

Figure 2:
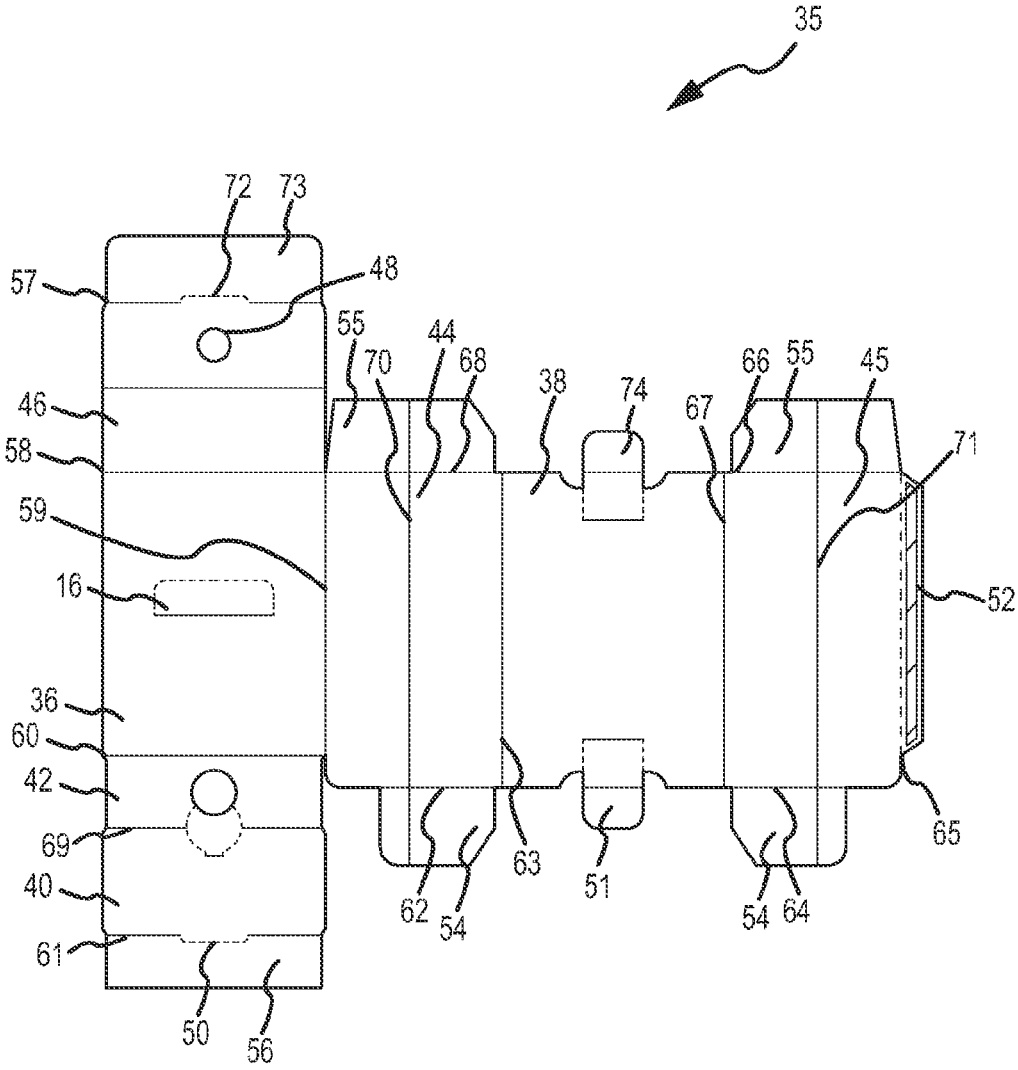
FIG. 2 illustrates a plan view of a blank sheet used for making the outer shell according to an embodiment of the present invention.

The outer shell 10 may be constructed from a single sheet of cardboard or similar material. As shown in FIG. 2, a single sheet 35 of cardboard may be folded along predetermined fold lines so that the outer shell 10 may be formed. It will be appreciated that this single sheet configuration is advantageous for several reasons. For example, automated manufacturing processes may be used to cut the sheet in one step (e.g. using a die cut). Similarly, artwork (e.g., labels, logos, directions, etc.) may easily be stamped or otherwise placed onto the cardboard sheet during manufacturing.

The assembly, packaging, and use of the container may be implemented in the following manner. As shown in FIG. 2, the outer shell 10 may be formed by folding a pre-cut cardboard sheet 35 consisting of multiple panels to form a generally rectangular-shaped container having side panels 44, 45, a front panel 40, a rear panel 46, a top panel 36, and a bottom panel 38. The outer shell 10 may, for example, be assembled by first folding the sheet 35 along fold lines 59, 63, and 67. Each panel should be folded so that the side panels 44, 45 lie in a plane which is perpendicular to the top panel 36 and bottom panel 38. Next, a tab 52 may be folded along fold line 65 and secured to the underneath edge of top panel 36 using a suitable adhesive.

Figure 5:
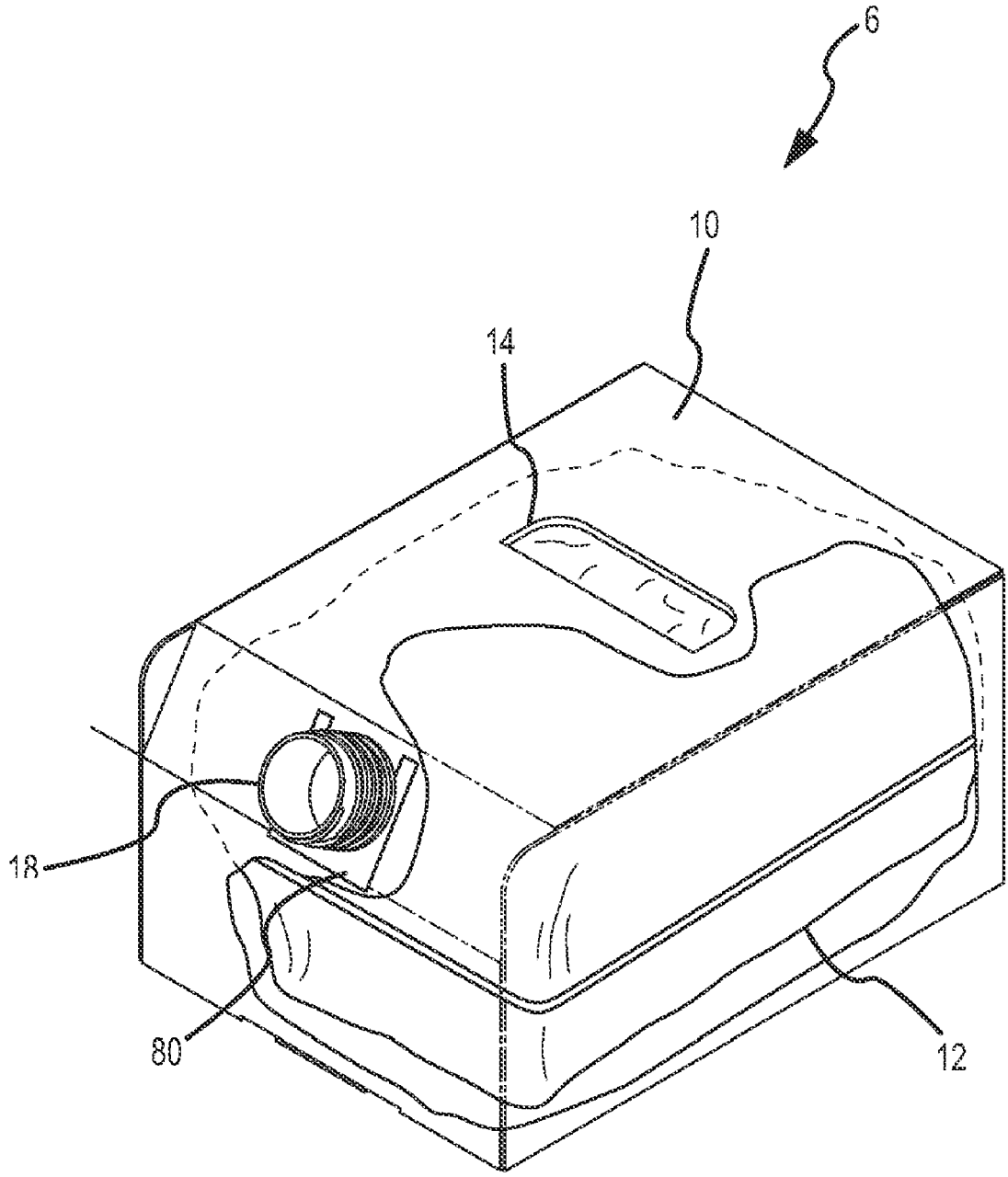
FIG. 5 illustrates a cutaway view of the outer shell including an expandable bag enclosed within the outer shell according to an embodiment of the present invention.

The expandable bag 12 may be positioned inside of the outer shell 10. The expandable bag 12 may be positioned prior to the folding of the sheet 35 or it may be positioned after at least one panel of the sheet 35 has been folded. The expandable bag 12 is constructed from a material suitable for containing a liquid. Although many types of materials may be used, it is preferable that the expandable bag 12 includes a dual-layered liner, wherein the inner liner comprises multi-polymer laminate and the outer liner comprises nylon laminate. The dual-layered liner configuration provides an expandable bag 12 that is resistant to puncture and prevents the permeation of flammable liquids. FIG. 5 illustrates the position of the expandable bag 12 inside of the outer shell 10 of the container 6. Attached to an opening in the expandable bag 12 is the spout 18.

Figure 8:
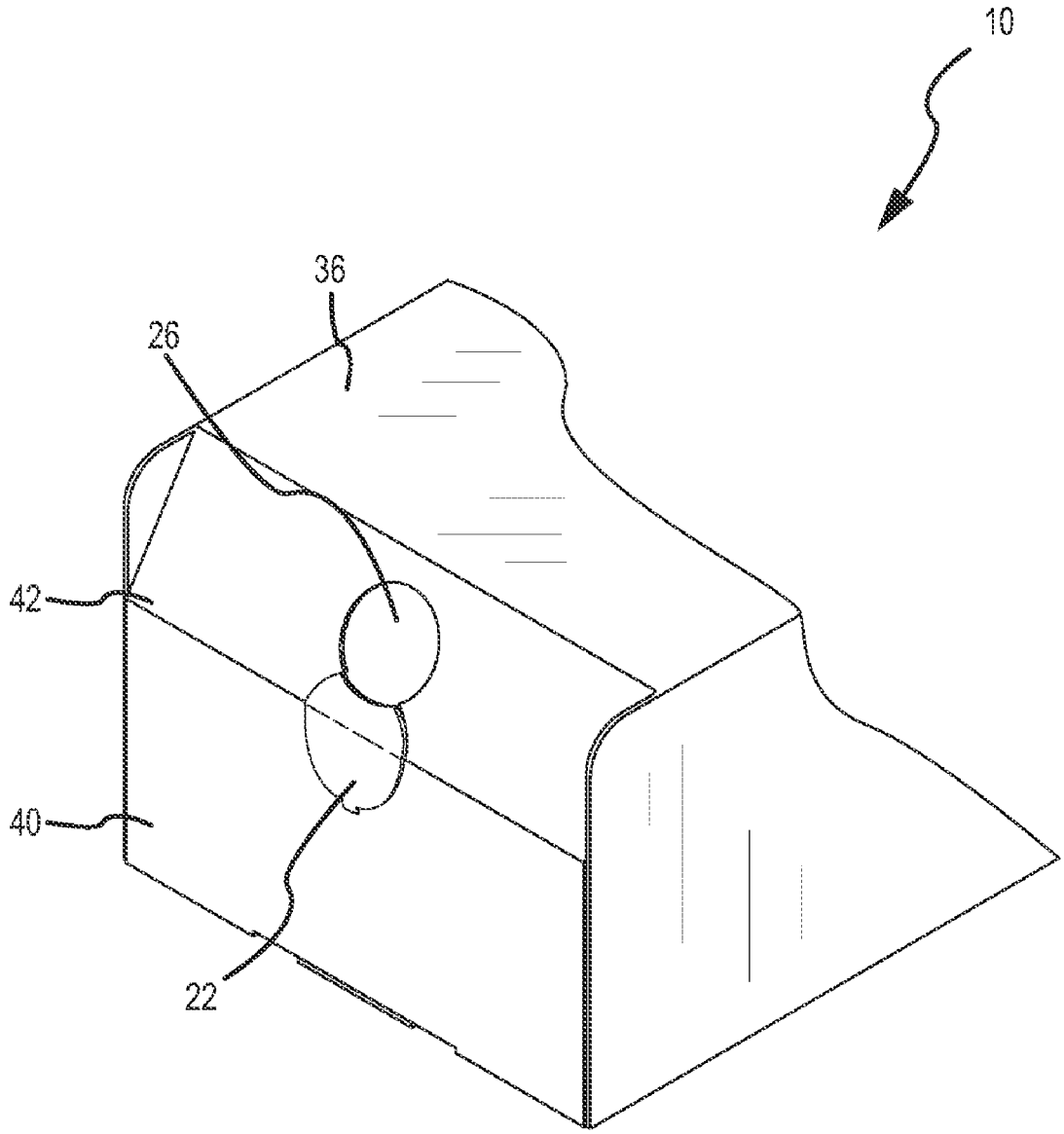
FIG. 8 illustrates a side perspective view of a portion of the outer shell of an embodiment of the present invention without a spout.
Figure 11A:
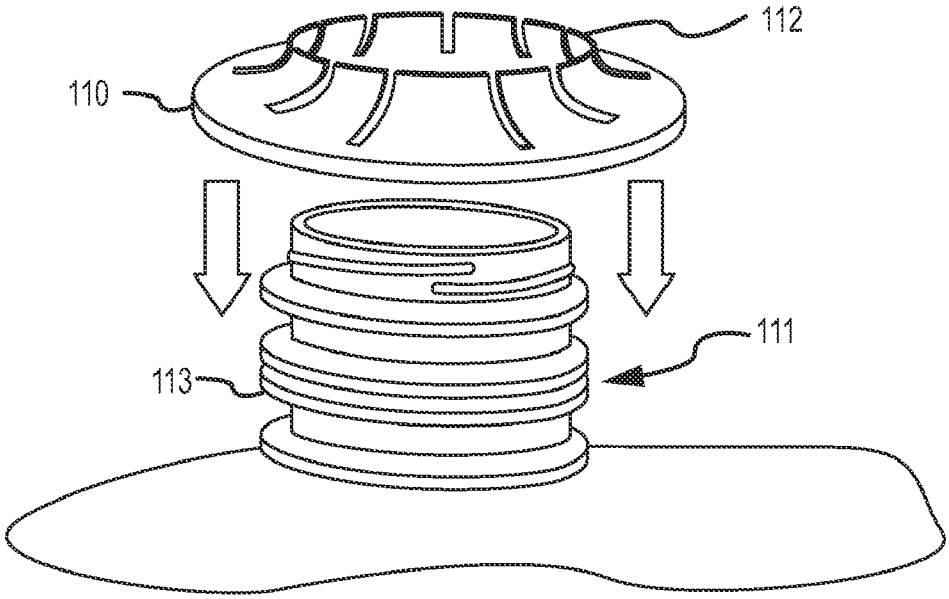
FIGS. 11A and 11B illustrate another embodiment of a neck support member.
Figure 11B:
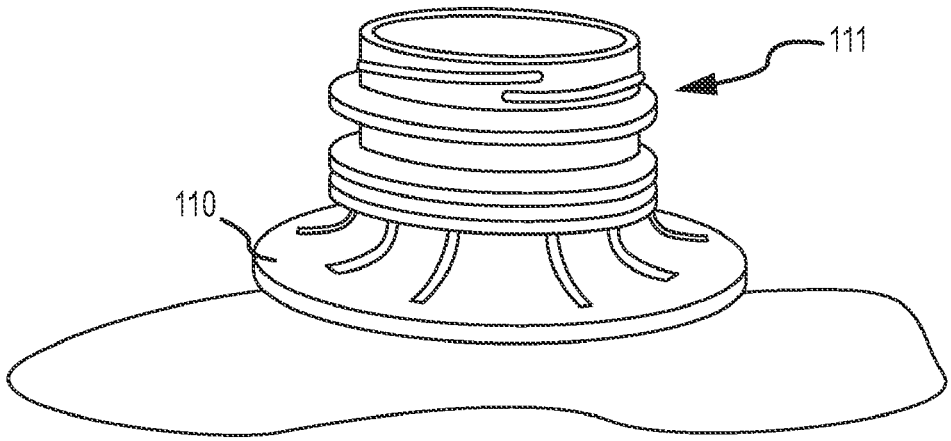

During assembly of the container 6, the spout 18 may be passed through a spout opening 26 (shown in FIG. 8) in a sloped front panel 42 of the outer shell 10. The spout opening 26 has a diameter that is smaller than the outer diameter of at least a portion of the spout 18 so that the spout 18 will not recede back through the spout opening 26 once installed. As shown in FIG. 8, the outer shell 10 includes a perforated member 22 positioned underneath the spout opening 26. The perforated member 22 consists of a flap that is secured to the outer shell 10, wherein at least a portion of the circumference of the spout opening 26 includes the perforated member 22. The perforated member 22 may be pushed inward or outward to allow the spout 18 to pass through an opening present when the perforated member 22 is pushed inward or outward. The spout may then be moved from the region of the perforated member 22 to the spout opening 26 during assembly. Then, the perforated member 22 may be realigned in the same plane as the sloped front panel 42 so that the spout 18 cannot retreat into the outer shell 10. Next the neck support member 80 may be installed in a position between a flange 20 on the spout 18 and the sloped front panel 42 of the outer shell 10. The position of an installed neck support member is shown generally in FIG. 4. Additional embodiments of a flange on a spout are shown for example in FIGS. 9, 11, and 13. Returning to FIG. 4, the neck support member 80 serves to provide support for the spout 18 when forces are applied during the filling and emptying of the container. The functions and various embodiments of the neck support member 80 are discussed in greater detail below.

In order to provide for more efficient shipping, storing, and to facilitate the single use feature, the pouring spout member may be unconnected from the rest of the container when an embodiment of the invention is sold to users. Additionally, the container portion may be assembled as described above, and then the top panel 36 may be collapsed toward the bottom panel 38 by pressing inward along fold lines 70 and 71. Bottom flaps 56 and 73 may be folded toward the bottom panel 38 and secured thereto by a suitable adhesive. Then, the pouring spout member 30 and the collapsed container may be packaged (e.g., wrapped in plastic) for sale to users. The pouring spout member 30 may be offset relative to a centerline of the collapsed container to allow multiple containers to nest together during storing and shipping.

FIGS. 15A-F illustrate steps a user may take to operate an embodiment of the invention for its intended use. First, a user may unwrap the collapsed container 6 and the pouring spout member 30 from their packaging. Second, as shown in FIG. 15A, the bottom flaps 56 and 73 may be lifted away from the bottom panel 38. Third, as shown in FIG. 15B, the user may expand the collapsed container by separating the top panel 36 from the bottom panel 38. Fourth, side tabs 54, 55 may be folded inward so that they are perpendicular with the side panels 44, 45. The front panel 40 and sloped front panel 42 may be folded along fold lines 60, 61, 69 to form the front of the outer shell 10, as shown in FIG. 15C. A bottom tab 51 is inserted into a bottom tab insert 50 of the front panel 40 to secure the front panel 40 in place, as shown in FIG. 15D. Similarly, the rear panel 46 is folded along fold lines 57, 58 to form the rear of the outer shell 10, as shown in FIG. 15C. A bottom tab 74 is inserted into a bottom tab insert 72 of the rear panel 46 to secure the rear panel 46 in place. Fifth, as shown in FIG. 15E, the user may fill the container 6 with a liquid, such as gasoline. Sixth, as shown in FIG. 15F, the user may press the pouring spout member 30 onto the spout 18 of the container 6.

Figure 14:
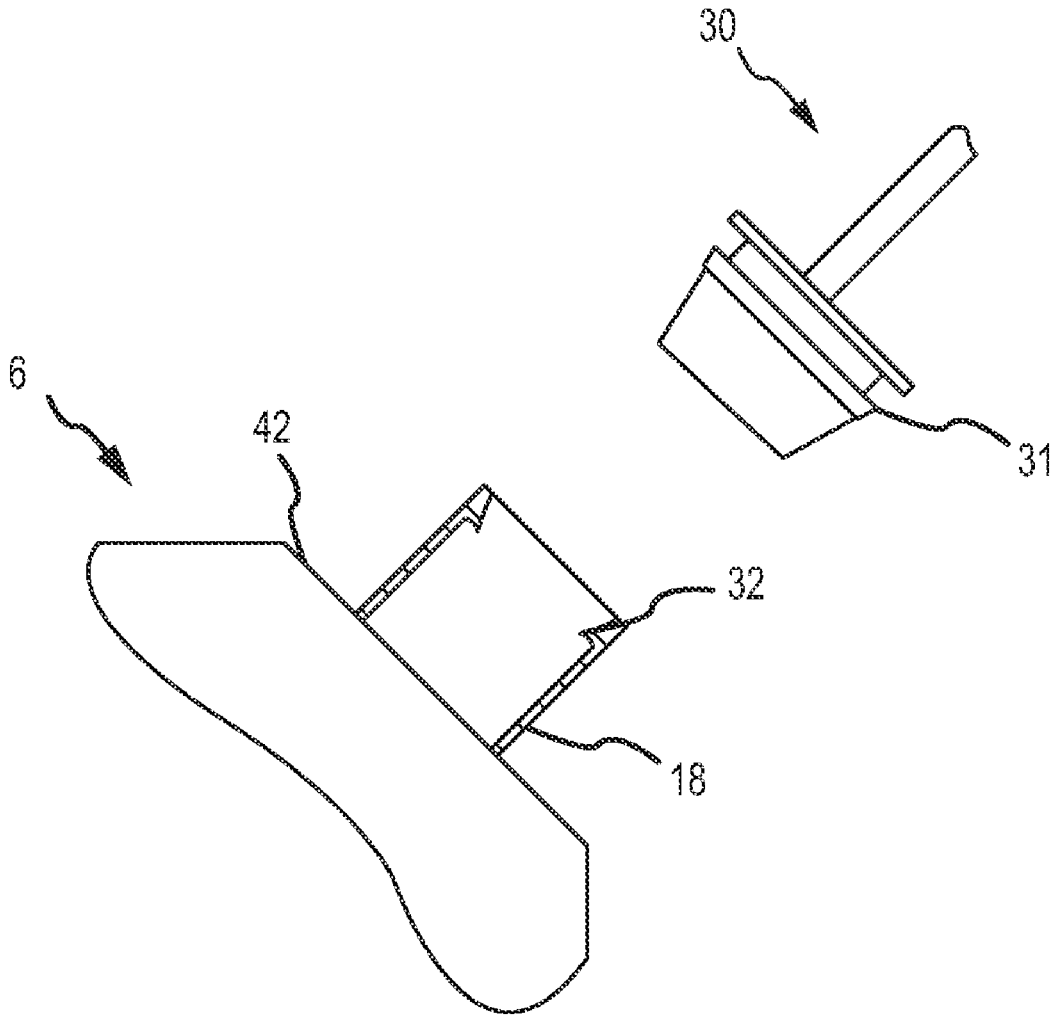
FIG. 14 illustrates an example of the locking mechanism between the spout and the pouring spout member according to an embodiment of the present invention.

As illustrated in FIG. 14, the pouring spout member 30 and the spout 18 may be configured so that once the pouring spout member 30 has been attached to the spout 18, a non-releasable connection is formed. In the exemplary embodiment of FIG. 14, the pouring spout member 30 has an external beveled edge 31. Additionally, the spout includes an internal stepped member 32. The external beveled edge 31 may have a minimum cross dimension that is greater than a maximum cross dimension of the opening of the internal stepped member 32. Accordingly, when the external beveled edge 31 is slidably moved past the internal stepped member 32, either the external beveled edge 31, the internal stepped member 32, or a combination of the two will deform to allow the external beveled edge 31 to move past the internal stepped member 32. Once the internal stepped member 32 has moved past the external beveled edge 31, the two parts will substantially return to their previous dimensions. Since the lower edge of the internal stepped member 32 and the upper edge of the external beveled edge are substantially flat, a pulling force imparted on the spout member 30 will generally not result in a force tending to expand the internal stepped member 32 and/or contract the external beveled edge 31. In this regard, the two parts form a locking mechanism between the pouring spout member 30 and the spout 18. As a result of this locking mechanism, once the pouring spout member 30 is placed on the spout 18, it is permanently in place and the spout 18 is no longer directly accessible for filling the container 6. Thus, the container 6 becomes a disposable, single use device. A single use container is advantageous when handling flammable liquids, as it, inter alia, discourages users from storing the liquids for extended periods of time. Finally, the user may dispense the liquid into a liquid storage receptacle (e.g., an automobile gas tank), and discard the container 6.

Figure 3:
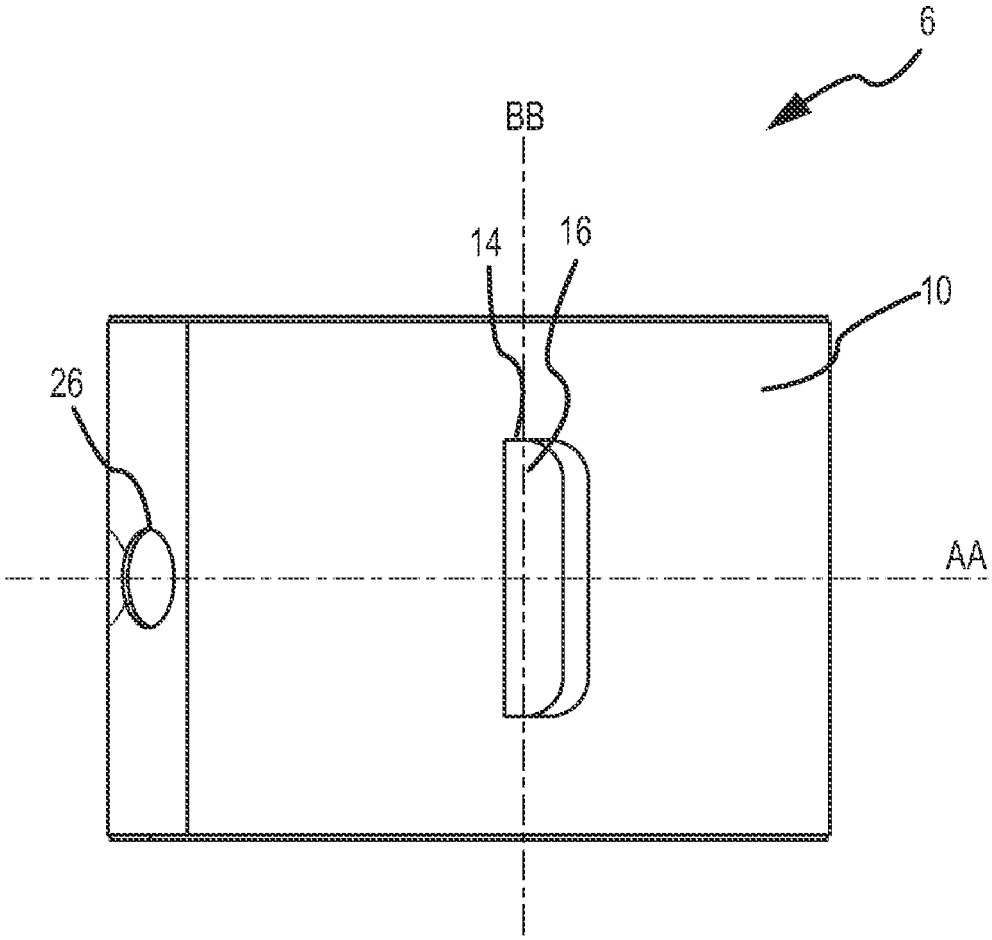
FIG. 3 illustrates a top plan view of the container of an embodiment of the present invention.

Embodiments of the present invention may include a handle 14 for carrying the container as shown in FIG. 3. The handle 14 may be located on the top panel 36 of the outer shell 10 and may be formed by pressing a perforated handle flap 16 inside the outer shell 10. As shown, the perforated portion of the handle flap 16 is positioned such that it rotates toward the spout 18 of the container when pressed. Alternatively, the perforation portion of the handle flap may be positioned such that it rotates away from the spout 18 of the container when pressed. The generally rectangular handle 14 may be positioned transverse to a pouring axis AA of the container 6. Additionally the handle 14 may be positioned along an axis BB such that the container may be balanced when a user transports the container by the handle 14. It will be appreciated that this design provides a sturdy handle 14 for transporting the container 6 by utilizing the top panel 36 of the outer shell 10 as a support. Furthermore, the rear panel 46 may contain a finger insert 48, as shown in FIG. 2. Along with the handle 14, the finger insert 48 allows the user to safely transport the container 6 and pour a liquid into another receptacle. For example the user may insert the fingers of one hand into the handle 14 and the thumb of the other hand into the finger insert 48 to provide stability while pouring a liquid. Alternatively, the user may hold the container 6 with one hand by placing a finger in the finger insert 48 and their thumb into the handle 14, or vice versa. The latter method allows a user to maintain a free hand while transporting or pouring a liquid.

Figure 4:
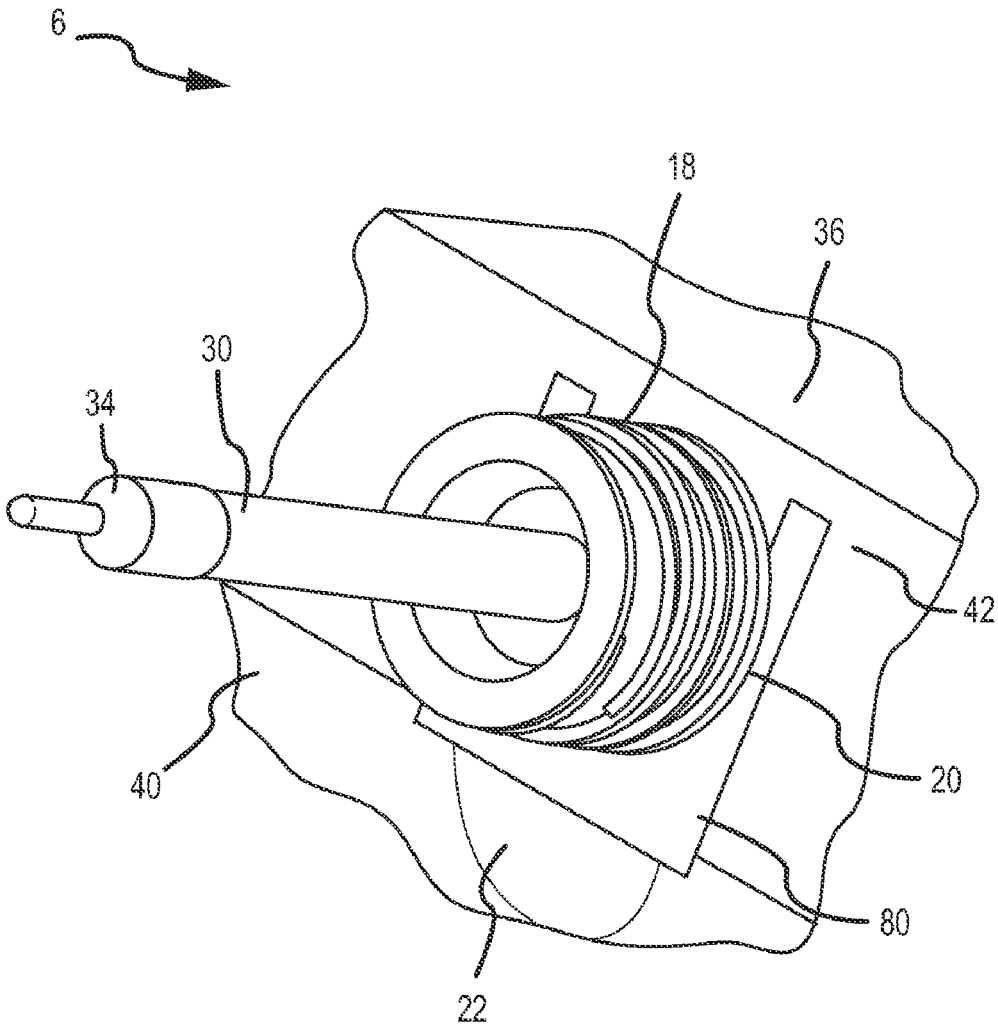
FIG. 4 illustrates a perspective side view of a spout, pouring spout member, and neck support member according to an embodiment of the present invention.

As shown in FIG. 4, the pouring spout member 30 may be attached to the spout 18 of the container 6. The pouring spout 30 allows a user to pour the liquid into a receptacle such as a gas tank of a vehicle without spilling the liquid. In one embodiment, the pouring spout member 30 is constructed of a flexible material such as plastic, which allows a user to easily place the pouring spout member into an opening of another receptacle. The pouring spout member 30 may be transparent to allow the user to see the liquid flowing as it is being poured. Additionally, the pouring spout member 30 may include a cap 34. The cap 34 may be placed on the end of the pouring spout member 30 when transporting the liquid to prevent spilling. Furthermore, the cap 34 may be easily removable from the pouring spout member 30 so that a liquid can be dispensed.

Figure 6:
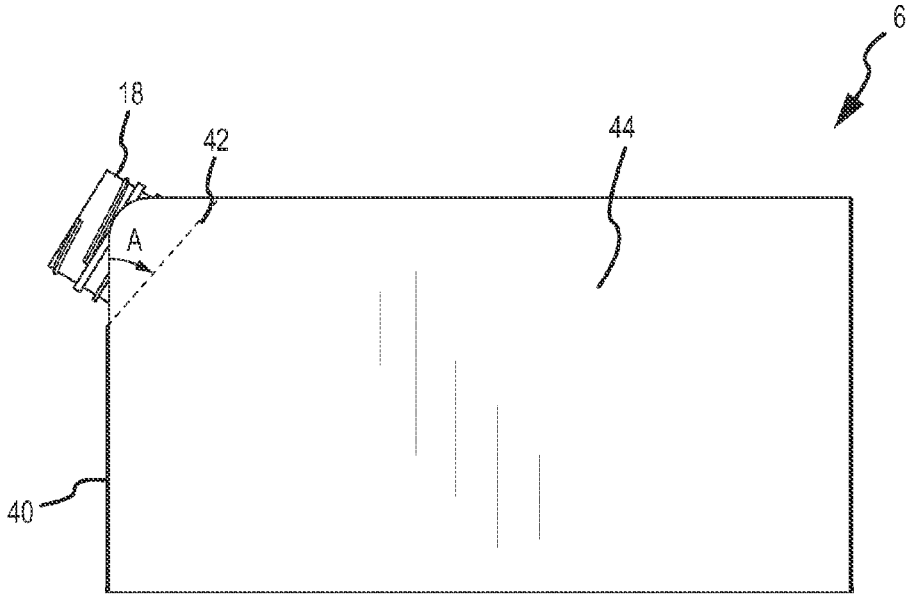
FIG. 6 illustrates a side view of an embodiment of the present invention.
Figure 7:
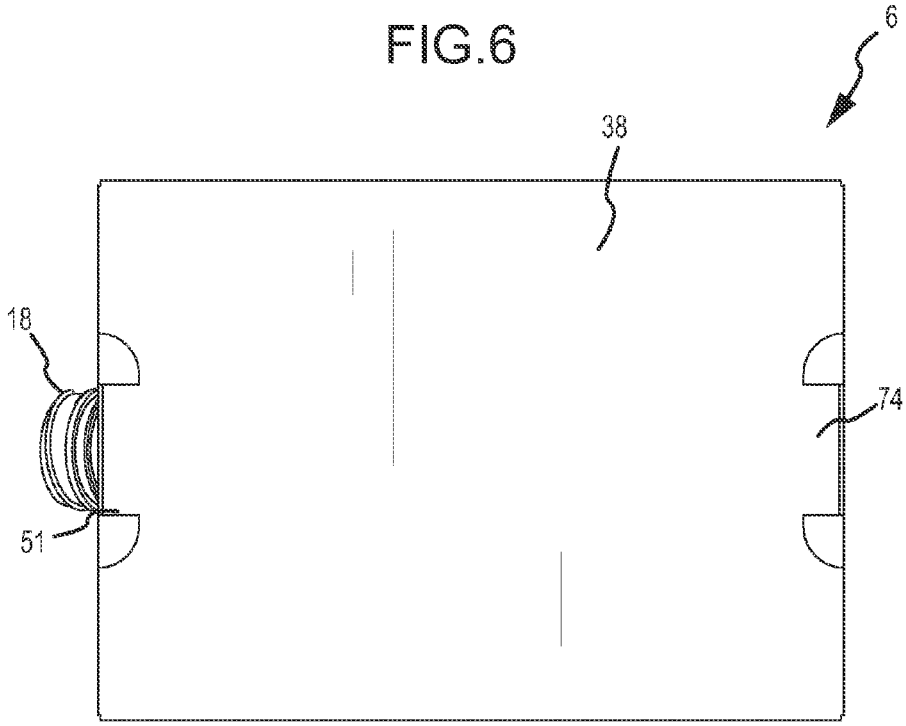
FIG. 7 illustrates a bottom plan view of an embodiment of the present invention.

Yet another feature of an embodiment may be the sloped front panel 42 of the outer shell 10, shown in phantom in FIG. 6. The sloped front panel 42 includes the spout opening 26 where the spout 18 protrudes through the outer shell 10. Relative to the front panel 40, the sloped front panel 42 may be positioned at an angle A, which is represented by an arcuate arrow in FIG. 6. Angle A should preferably be between 15 and 75 degrees, more preferably between 30 and 60 degrees, for example 45 degrees. A sloped front panel is advantageous for several reasons. For example, it is desirable to have the spout 18 and pouring spout member 30 extend from the body of the container 6 at an angle other than horizontal or vertical so that pouring a liquid is easier for a user. In this regard, if the pouring spout member 30 extended vertically from the body of the container 6, the container would need to be severely tilted when dispensing a liquid into another receptacle. Alternatively, if the pouring spout member extended horizontally from the body of the container, a liquid may spill out of the container even when the container is held substantially horizontal. One way to achieve this angled position of the spout 18 is to position the spout opening 26 at the intersection of two perpendicular panels. This configuration is undesirable because the primary forces applied to the spout 18 and outer shell 10 during the dispensing of a liquid would act on relatively small sections of the two perpendicular panels. Conversely, when the spout opening 26 is positioned entirely on a front sloped panel 42, the primary forces applied to the interface comprising the spout 18 and outer shell 10 while pouring a liquid are evenly distributed around the circumference of the spout opening 26 in the outer shell 10. Thus, positioning the spout opening 26 on a sloped front panel 42 provides for a more durable construction of the container.

Turning now to FIGS. 9 through 13, these figures illustrate exemplary embodiments of neck support members. The primary function of a neck support member is to retain the position of a spout relative to the sloped front panel 42 during the installation of the pouring spout member 30 onto the spout. A neck support member is generally positioned at the base of a spout and lies in a face-to-face relationship with the sloped front panel 42 of the outer shell 10 of the container 6. A neck support member should provide enough support so that the position of a spout is maintained during various stresses on the container that may occur during the filling, transporting, or emptying of a liquid. Additionally, it will be appreciated that a neck support member should be easily installable and relatively low cost.

Figure 9:
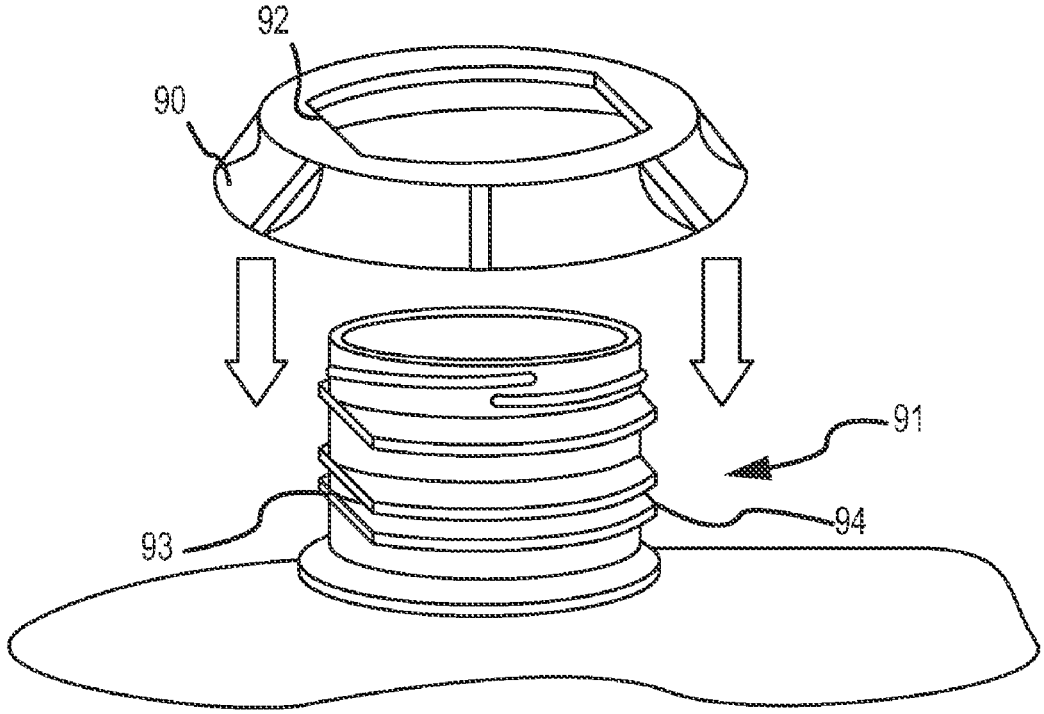
FIG. 9 illustrates a one embodiment of a neck support member.

Referring now to FIG. 9, an embodiment of a neck support member 90 is illustrated. As shown, a spout 91 and the neck support member 90 are configured so that the neck support member 90 may pass axially over the spout 91 only when the two are rotatably aligned with each other in a particular manner during installation. In the example shown, the spout 91 and neck support member 90 have corresponding flat sections 92, 93 on opposites sides that permit the neck support member 90 to pass axially over the spout 91 only when the flat sections 92, 93 are aligned with each other. Once the neck support member 90 is positioned in a face-to-face relationship with the sloped front panel 42 (not shown), the neck support member 90 and/or the spout 91 may be rotated relative to each other so that the flat sections 92, 93 on each are no longer aligned. When the flat sections 92, 93 are no longer aligned, the neck support member 90 cannot be removed from its position between a flange 94 on the spout 91 and the container 6 without further rotation. A person of ordinary skill in the art will appreciate that this embodiment is not limited to the particular example illustrated.

Figure 10A:
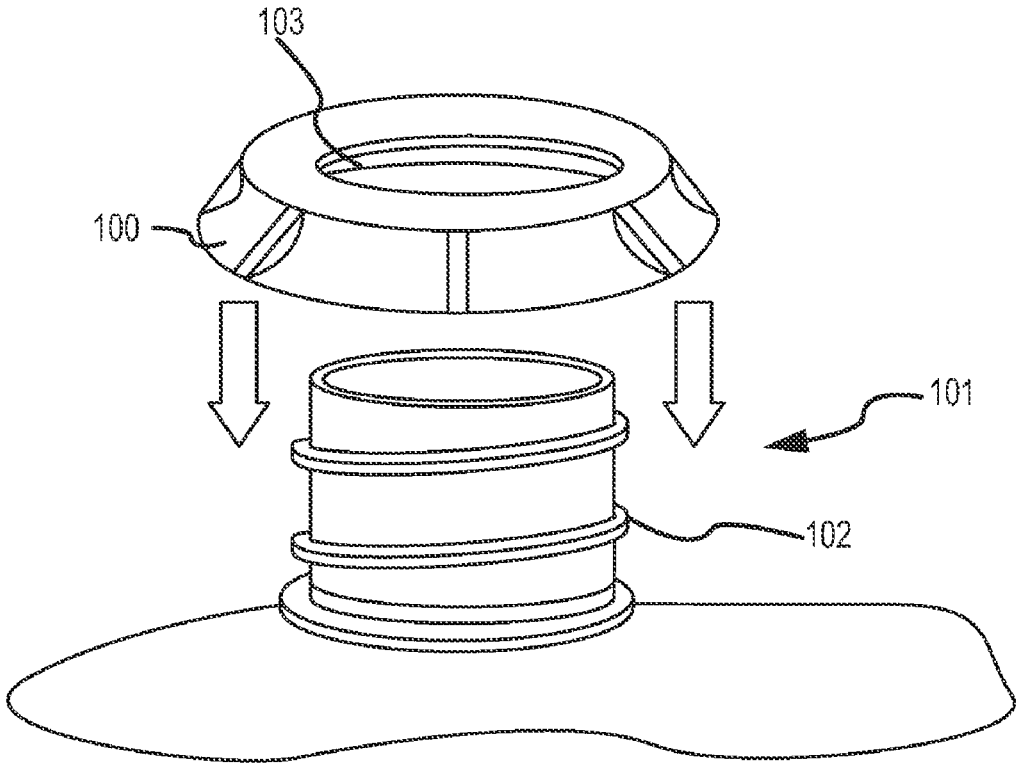
FIGS. 10A and 10B illustrate another embodiment of a neck support member.
Figure 10B:
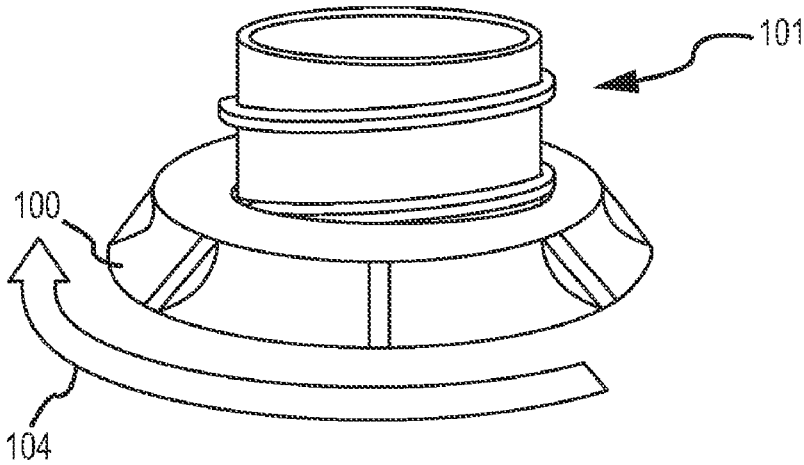

Referring now to FIGS. 10A and 10B, another embodiment of a neck support member 100 is illustrated. In this embodiment, a spout 101 contains an exterior threading 102. Additionally, the neck support member 100 contains an interior threading 103 that allows for threadably engaging the neck support member 100 onto the spout 101 during installation. A curved arrow 104 illustrates the rotating motion utilized when installing neck support member 100. The neck support member 100 is threadably engaged to the spout 101 until the neck support member 100 is in a face-to-face relationship with the sloped front panel 42 (not shown). It will be appreciated that the neck support member 100 may be secured in its position once installed at the base of the spout 101.

Referring now to FIGS. 1A and 1B, yet another embodiment of a neck support member 110 is illustrated. As shown, the neck support member 110 has flexible tabs 112 along its inner circumference. During installation, the neck support member 110 may be pressed over a spout 111 until the neck support member 110 lies in a face-to-face relationship with the sloped front panel 42 (not shown). The flexible tabs 112 are shaped so as to permit the neck support member 110 to move over a flange 113 at the base of the spout 110 when the neck support member 110 is advanced in the direction of the container 6 only. Thus, when the neck support member 110 is pressed over the flange 113, it is securely positioned between the flange 113 and the sloped front panel 42 of the outer shell 10 of the container 6.

Figure 12:
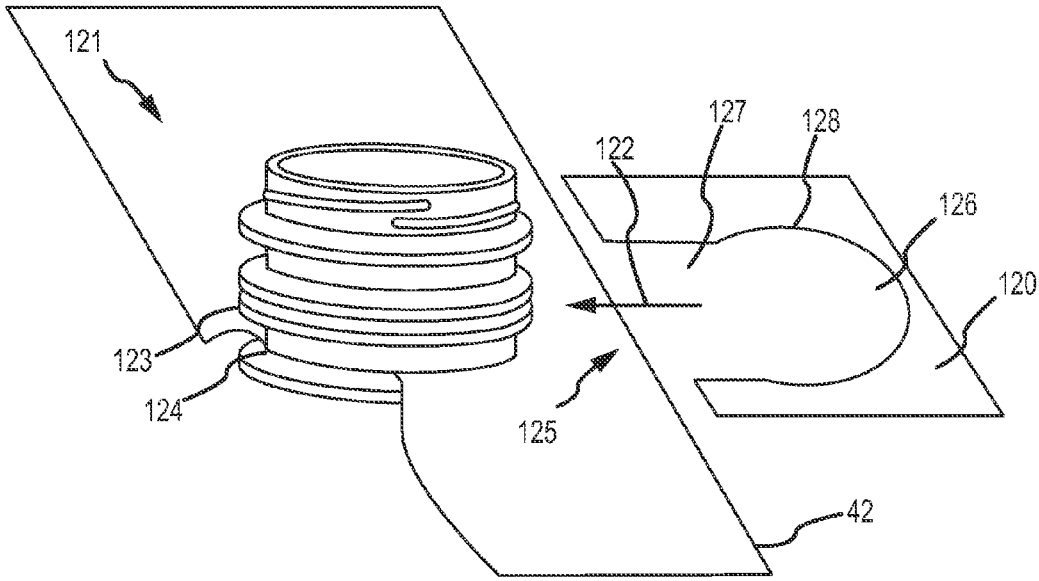
FIG. 12 illustrates another embodiment of a neck support member.

Referring now to FIG. 12, yet another embodiment of a neck support member 120 is illustrated. In this embodiment, the neck support member 120 is installable by placing it in a face-to-face relationship with the sloped front panel 42 and laterally advancing at least one of the neck support member 120 and a spout 121 toward each other as shown by an arrow 122. After installation, at least a portion the neck support member 120 may be positioned between a flange 123 of the spout 121 and the sloped front panel 42. Furthermore, the neck support member 120 may be configured such that when in an installed position, it can only be removed from that position by laterally disengaging it from a base 124 of the spout 121. For instance, in the example shown, the neck support member 120 has a keyhole-shaped opening 125 extending to a peripheral edge. The opening 125 has a circular internal portion 126 and a mouth portion 127. The mouth portion 127 has a cross dimension that is sufficient to allow the neck support member 120 to be laterally advanced (e.g., during installation of the neck support member) relative to the base 124 of the spout 121 until a peripheral edge 128 of the internal portion 126 is positioned between the flange 123 and the front sloped panel 42. For example, the mouth portion 127 may have a cross dimension that is within 15 percent of the maximum cross dimension of the base 124. The mouth portion 127 may have a cross dimension that is slightly less than the maximum cross dimension of the base 124. The internal portion 126 has an inner diameter that is smaller than the outer diameter of the flange 123, so that once installed, the neck support member 120 cannot be axially displaced. It will be appreciated that any shape for the neck support member 120 may be utilized as long as the configuration does not permit the neck support member 120 to move in an axial direction once installed. For example, in one embodiment the neck support member 120 may encompass only a portion of the spout 121. In that case, the neck support member 120 may be positioned at least along the bottom portion of the spout 121, where the primary forces may be applied when a liquid is being dispensed. In another embodiment, the neck support 120 member may encompass a substantial portion of the spout 121.

Figure 13:
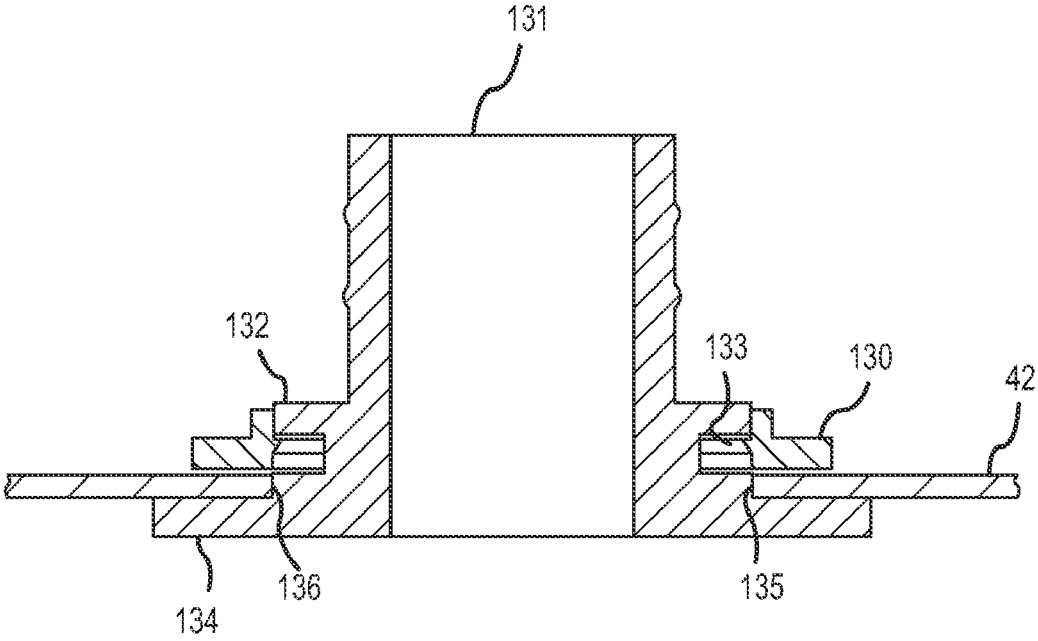
FIG. 13 illustrates a cross sectional view of another embodiment of a neck support member.

Referring now to FIG. 13, yet another embodiment of a neck support member 130 is shown. In FIG. 13, the neck support member 130, a spout 131 and the sloped front panel 42 are shown in cross section. The neck support member 130 may be a circular member completely encircling the spout 131. In the illustrated embodiment the neck support member 130 is circular and is installable by pressing it axially over the spout 131 and past a flange 132 located near the base the spout 131. The neck support member 130 is prevented from advancing beyond the position shown in FIG. 13 by the sloped front panel 42, which is between the neck support member 130 and a large flange 134 at the bottom of the spout 131.

The neck support member 130 is configured with a beveled edge 133 along its inner circumference. As shown, the beveled edge 133 is tapered radially inward in a direction that is away from the sloped front panel 42 when the neck support member 130 is in an installed position. The beveled edge 133 has a minimum diameter that is smaller than the outer diameter of the flange 132. The beveled edge 133 is preferably constructed from a material that is resilient, which allows it to pass over the flange 132 when the neck support member 130 is pressed over the spout 131 in the direction of the sloped front panel 42. Moreover, the internal beveled edge 133 is shaped such that its inner circumference is flexibly expanded when pressed over the flange 132 in the direction of the sloped front panel 42, and its inner circumference is not flexibly expanded when pressed against the flange 132 in the direction away from the sloped front panel 42. This design creates a locking mechanism that secures the location of the neck support member 130 between the flange 132 of the spout 131 and the sloped front panel 42 of the outer shell 10 of the container 6. A person skilled in the art will recognize that, as with other embodiments described herein, the neck support member 130 may not extend fully around the exterior of the spout 131. For instance, in one embodiment, the neck support member 130 may be "C" shaped and may only extend around a portion of the spout 131. Furthermore, the outer portion of the neck support member 130 may be sized and shaped such that the neck support member 130 is incapable of passing through the opening 135 of the sloped front panel 42.

The spout 131 may be confined laterally within the opening 135 in the sloped front panel 42 by virtue of a boss 136 on the spout 131 that may be sized and shaped to correspond to the opening 135. The opening 135 may be sized such that the large flange 134 is incapable of passing through the opening 135. Furthermore, the opening 135 may be sized such that the flange 132 may pass through the opening 135.

Accordingly, during assembly the spout 131 may be inserted into the opening 135 until the boss 136 is positioned within the opening 135. The neck support member 130 may then be installed by pressing it axially over the spout 131 until it is locked in place as shown in FIG. 13. Thusly, the spout 131 is laterally confined in the position shown in FIG. 13 by the opening 135 in the sloped front panel 42 and axially confined in the position shown in FIG. 13 by the neck support member 130 and the sloped front panel 42. Alternatively, the neck support member 130 may be positioned proximate to the opening 135 and the spout 131 may then be inserted into the opening 135/neck support member 130, until the spout 131 is positioned as shown in FIG. 13. Alternatively, the neck support member 130 and the spout 131 may be simultaneously advanced toward the opening 135 until they are positioned as shown in FIG. 13.

Figure 16:
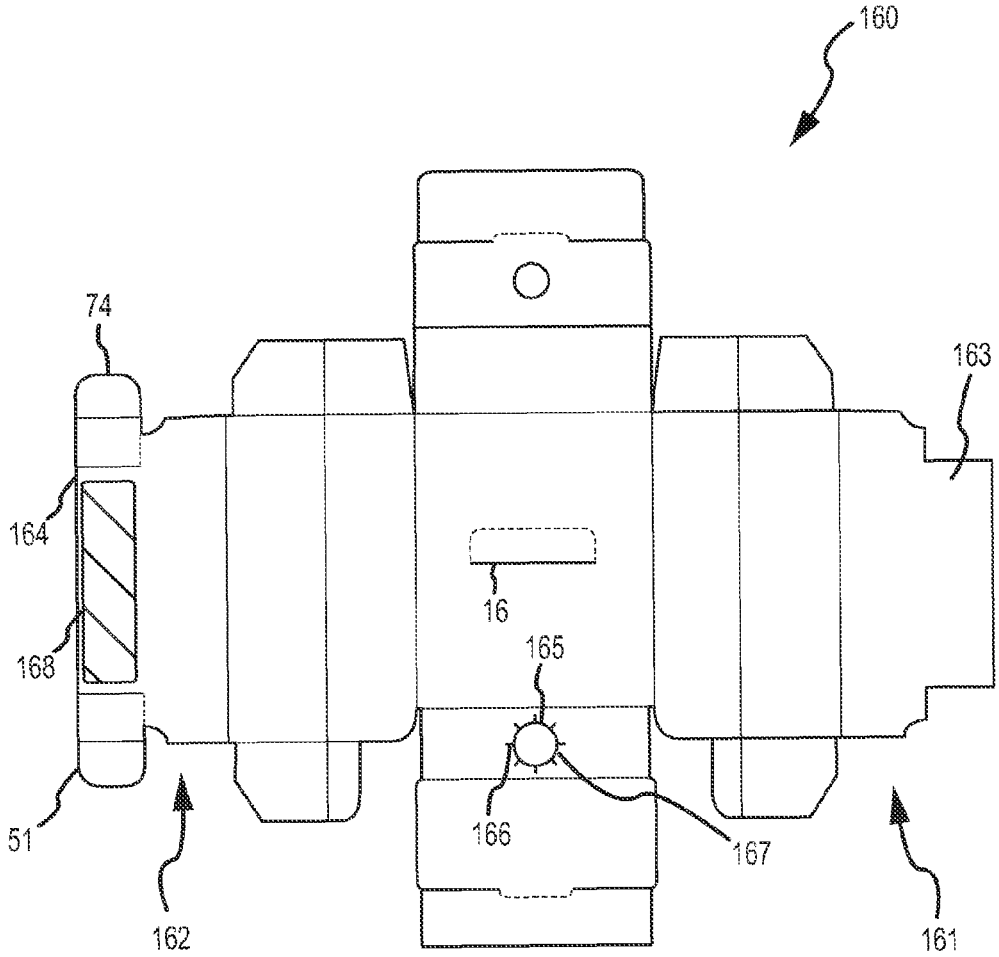
FIG. 16 illustrates an embodiment of a pre-cut blank.

Turning to FIG. 16, an alternate embodiment of a pre-cut, unfolded outer shell 160 is illustrated. The unfolded outer shell 160 may, for example, be made of cardboard. Many of the features of the unfolded outer shell 160 are similar to features of the pre-cut cardboard sheet 35 of FIG. 2 and therefore will not be discussed. One difference between the unfolded outer shell 160 and the pre-cut cardboard sheet 35 of FIG. 2 is that the unfolded outer shell 160 is configured so that the bottom panel is divided into two sections: a first section 161 and a second section 162. Together, the sections 161 and 162 form the bottom panel after they are adhesively joined. The bottom tabs 51, 74 may be a part of either bottom panel section 161, 162. The outer shell may be assembled by placing adhesive 168 in an overlapping region 163 of the first section 161 and/or an overlapping region 164 of the second section 162. The two regions 163 and 164 may be brought together during the manufacturing process to form the outer shell.

When the outer shell 160 is assembled and filled, it may be transported by a user grasping the container by the perforated handle flap 16. In such a situation, the weight of the liquid within the container may place the bottom wall in tension. Accordingly, the interface between the overlapping regions 163 and 164 may be in shear.

Figure 17:
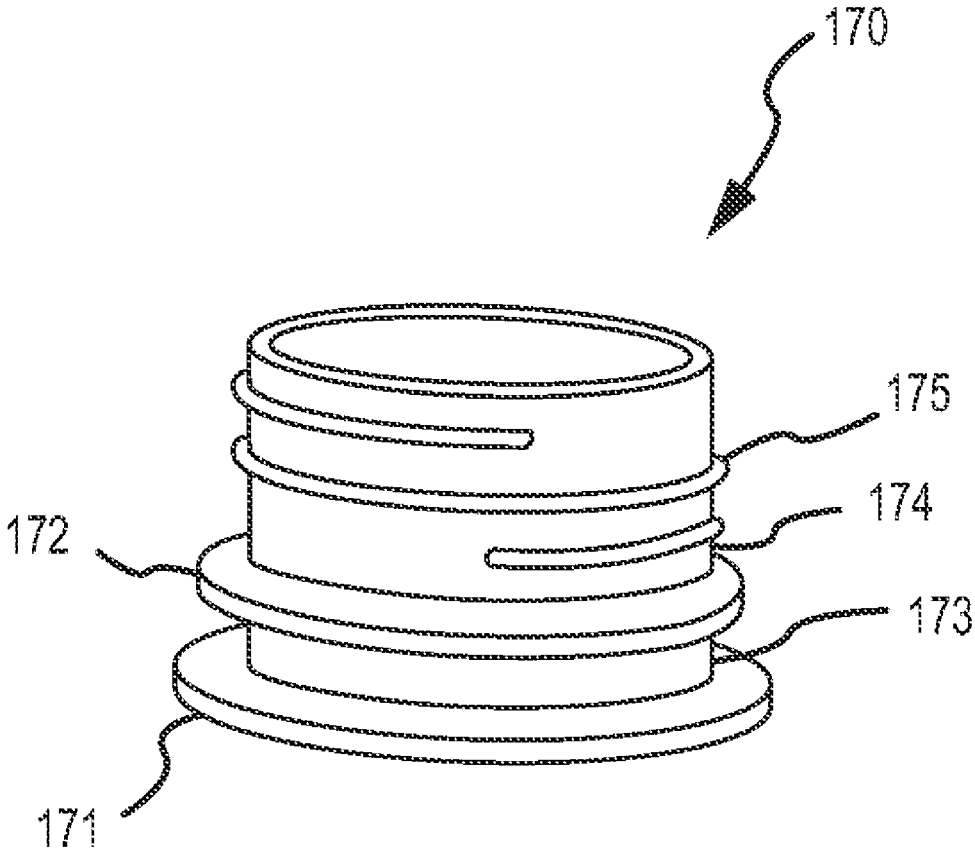
FIG. 17 illustrates an embodiment of a neck support member for use with the pre-cut blank of FIG. 16.

FIG. 16 also illustrates an alternate configuration for a spout opening 165. As shown, the spout opening 165 may have a plurality of radially disposed slits 166. The slits 166 may define a plurality of radially disposed bendable tabs 167 surrounding the spout opening 165. The tabs 167 may be configured to interface with a spout 170 as illustrated in FIG. 17. The spout 170 may include a first flange 171 and a second flange 172. The first flange 171 may be sized so that it is not operable to pass through the spout opening 165. The second flange 172 may be sized so that it is operable to pass through the opening 165 by bending the plurality of tabs 167. In this manner, the spout 170 may be forcibly inserted into the opening 165 until the second flange 172 passes beyond the plurality of tabs 167 and the plurality of tabs 167 are each located between the first 171 and second 172 flanges. Once in such a configuration, the spout 170 may be secured to the spout opening 167. Moreover, a region 173 of the spout 170 between the flanges 171, 172 may be sized to coincide with the diameter of the opening 165 to limit the amount of movement of the spout 170 relative to the outer shell 160.

A region 174 of the spout 170 above (as oriented in FIG. 17) the second flange 172 may contain an engagement feature to interface with a neck support member (not shown in FIG. 17). For example, the engagement feature may be male threads 175 that may interface with a neck support member similar to that discussed with reference to FIGS. 10A and 10B. Alternatively, for example, the engagement feature may be a snap or flange that may be operable to interface with a mating snap or flange on a neck support member.

Figure 18:
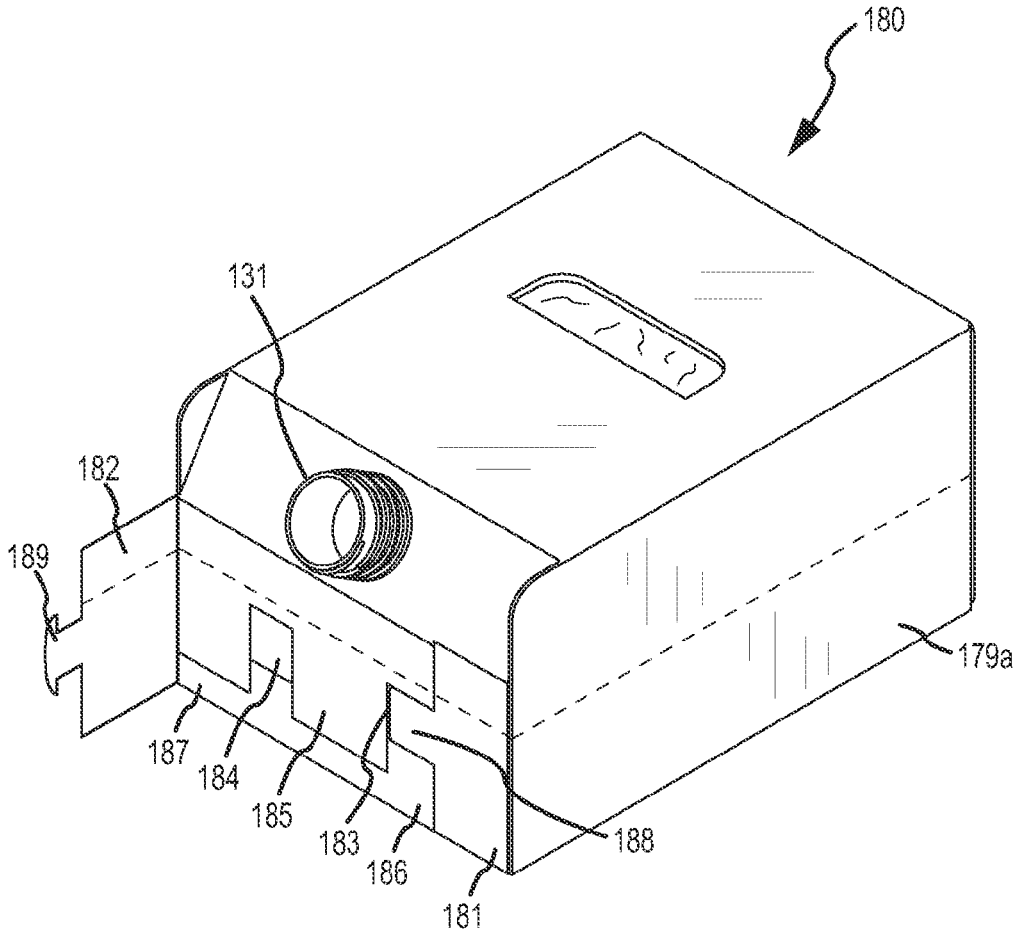
FIG. 18 illustrates a perspective view of an embodiment of the present invention.

FIG. 18 illustrates an embodiment of a container 180 for storing liquid that may be assembled by an end user by expanding the container 180 from a folded position (illustrated in FIG. 21) and tucking tabs into holes formed in the end panels of the container 180. For example, to form the container 180 as shown in FIG. 18, tab 188 has been inserted into hole 183. Tab 188 is connected to end flap 181. Similarly, tab 189, connected to end flap 182, which is shown in an uninserted configuration, may be inserted into hole 184. The holes 183 and 184 were formed by the joining of end sections 185, 186 and 187.

Figure 19:
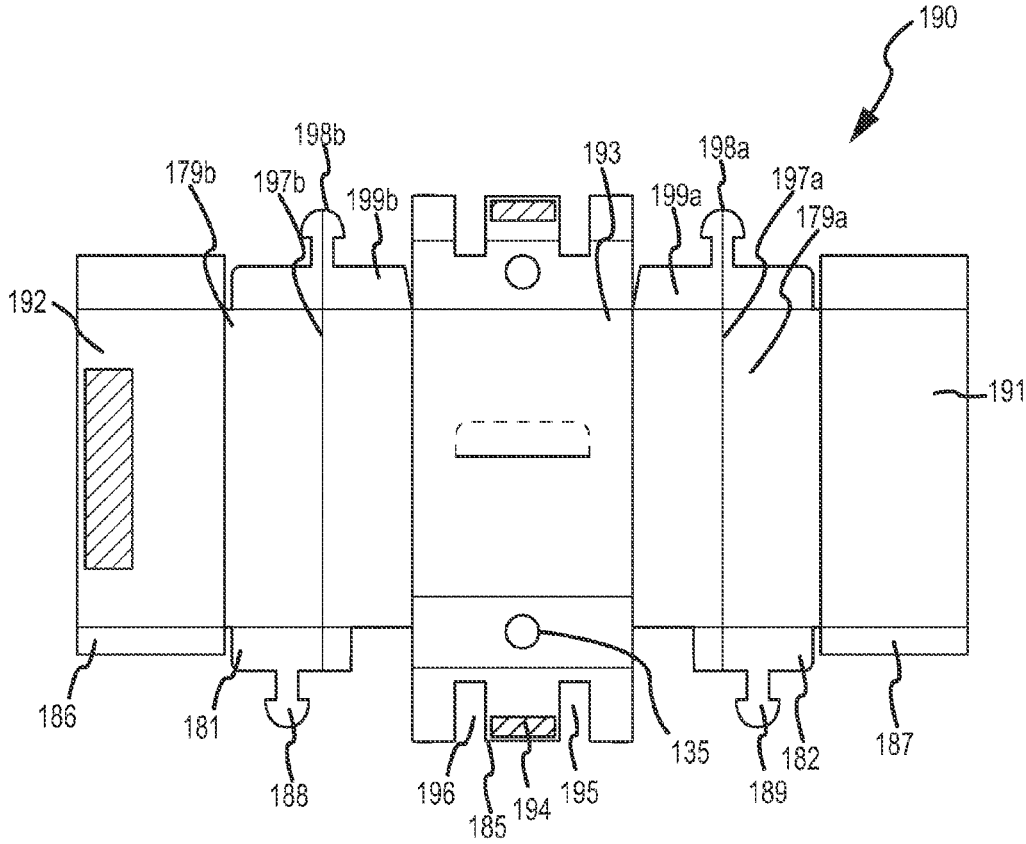
FIG. 19 illustrates a blank sheet used for making the outer shell according to the embodiment of FIG. 18.

FIG. 19 is an illustration of an outer shell 190 (in an unfolded state) that may be folded to produce the container 180 of FIG. 18. Many of the features of the outer shell 190 are similar to features of the pre-cut cardboard sheet 35 of FIG. 2 and therefore will not be discussed. As with the unfolded outer shell 160, the unfolded outer shell 190 is configured so that the bottom panel is divided into two sections 191, 192 that form a bottom panel of the container 180 after they are adhesively joined.

FIGS. 18 and 19 illustrate the container 180 and its associated unfolded outer shell 190 with four tabs 188, 189, 198*a* and 198*b*. Other embodiments may have a different number of tabs interconnected to different portions of the container. For example, in an alternate embodiment, an end flap, such as end flap 182, may be pivotably interconnected to an end section, such as end section 185, and the tab on the end flap may interconnect to a hole in a side panel. The end flap may be of any appropriate length and may wrap around one or more corners of the container. For example, an end flap interconnected to a side panel may wrap around an end panel an engage a hole disposed in the opposite side panel. Accordingly, embodiments of a container may include at least one flap that is pivotably interconnected to at least one side panel or end section and each of the at least one flaps may include a tab that is operable to be inserted into at least one of a hole in a side panel and a hole in an end section. Furthermore, the at least one flap may be operable to maintain the container in an expanded state once it is inserted into its corresponding hole.

Figure 20:
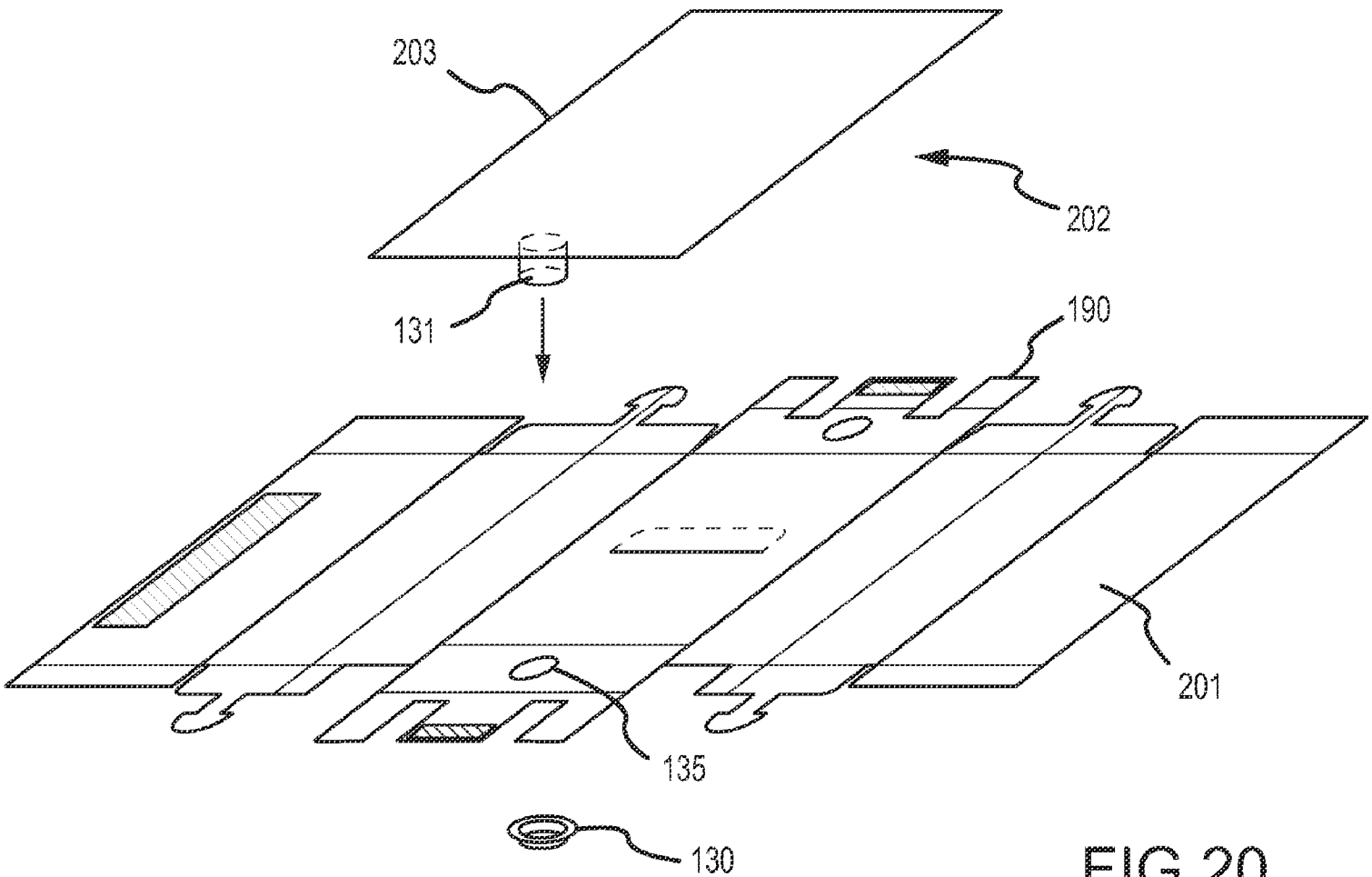
FIG. 20 illustrates a step of an exemplary assembly method of the embodiment of FIG. 18.

FIG. 20 illustrates a step in a method of manufacturing a container using the outer shell 190 of FIG. 19. A first step may be to orient the outer shell 190 so that a first surface 201 of the outer shell 190 (which, once the outer shell 190 is assembled, will be the inside surface of the container 180) is oriented to face in a direction from which a spout and bag assembly 202 will be fed. The spout and bag assembly 202 may include an expandable bag 203 fluidly interconnected to the spout 131.

The next step may be to interconnect the spout and bag assembly 202 and neck support member 130 to the unfolded outer shell 190. This may be accomplished by aligning the neck support member 130 with the opening 135 along the outside surface (not visible in FIG. 20) of the outer shell 190. This may be followed by inserting the spout 131 into the opening 135 and through the neck support member 130 until the neck support member 130 is positioned beyond the flange 132 of the spout 131 as described above with reference to FIG. 13. Alternatively, the spout and bag assembly 202 may be inserted into the opening 135 first and then the neck support member 130 may be pressed onto the spout 131. Alternatively, the spout and bag assembly 202 and the spout 131 may be brought together simultaneously, capturing the outer shell 190 between them.

Referencing FIG. 19, the outer shell 190 includes end sections 185, 186, and 187 that may be folded and glued together to form a first end of the container 180. The first end includes an opening 135 for the spout 131. To form the first end of the container 180, first the two sections 191 and 192 are folded and adhesively joined together. This step brings together the two end sections 186 and 187, which form a bottom portion end section (as seen in FIG. 18) of the first end of the container 180. This bottom portion end section is then folded toward the top portion 193 of the outer shell 190. Adhesive (e.g., glue) may then be applied to the top portion end section 185 in area 194 and the top portion end section 185 may then be folded to come into contact with and adhesively join to the bottom portion end section thereby forming the first end of the container 180. Gaps 195, 196 in the top portion end section 185 form holes 183, 184 once the top portion end section 185 is adhesively joined to the bottom portion end section. A similar process may be used to form a second end of the container 180 opposite from the first end. As shown in FIG. 19, the tabs 188 and 189 are offset from side panel fold lines 197*a*, 197*b*, while the tabs 198*a*, 198*b* of the second end of the container 180 are located along the side panel fold lines 197*a*, 197*b*. The tabs 188 and 189 are offset to allow for clearance around the opening 135 and the spout 131, which is installed into the opening 135. However, it will be appreciated that the positioning of the tabs and holes may be varied from that shown in FIG. 19.

After the two sections 191 and 192 are adhesively joined together and both ends of the container have been adhesively joined together, the container 180 will be configured such that, when viewed in lateral cross section and when viewed in longitudinal cross section, the container 180 includes a continuous band of material surrounding the interior volume of the container 180. The continuous bands of material in lateral and longitudinal cross section may be maintained during storage in a collapsed condition, through expansion prior to filling and through use as a container for storing liquids. In this regard, by adhesively joining together the two sections 191 and 192, and by adhesively joining together both ends of the container, permanent interconnections (e.g., through the side panels 179*a*, 179*b* and end sections) between the top portion 192 and the bottom of the container 180 may be formed. Moreover, in such a configuration, the side panels 179*a*, 179*b* and end sections may be free from direct interconnection with each other. Furthermore, such a configuration is advantageously free from edges of the outer shell 190 protruding into the interior volume of the container 180.

Figure 21:
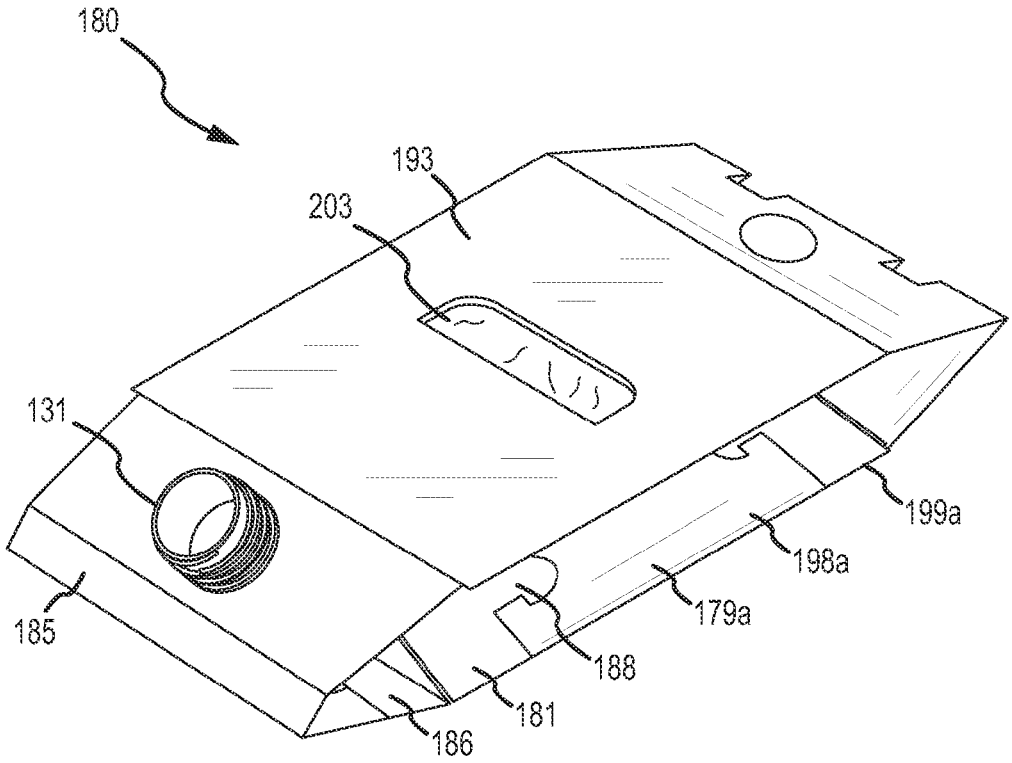
FIG. 21 illustrates a perspective view of the embodiment of FIG. 18 in a collapsed condition.

The next step may be to fold the side end flaps 181, 182 of the first end of the container and side end flaps 199*a*, 199*b* of the second end of the container so that they are flush with their respective side panels 179*a*, 179*b*. This position is illustrated in FIG. 21. The next step may be to collapse the container 180 in an accordion-like fashion such that the side panels 179*a*, 179*b* are folded inward and the end panels are folded outward as illustrated in FIG. 21. In another embodiment, at least one of the side panels 179*a*, 179*b* may be folded outward and at least one of the end panels may be folded inward. In yet another embodiment, all of the side panels 179*a*, 179*b* and the end panels may be folded outward. Flattening the container 180 advantageously reduces the volume of space taken up by the container 180 when it is not being used to store and/or transport liquids. This is beneficial to retailers since the container 180 will take up less shelf space and to consumers since the container 180 will take up less interior space within a vehicle.

The next step may be to place the pouring spout member 30 adjacent to the top or bottom panel of the container 180 and shrink wrap the container 180 and pouring spout member 30 together. The pouring spout member 30 may be positioned offset from a centerline of the container 180 so that subsequent shrink wrapped containers 180 may be arranged in a face-to-face or back-to-back arrangement with the pouring spout members 30 nesting adjacent to each other.

One or more of the above-described assembly processes may be performed manually. One or more of the above-described assembly processes may be performed in an automated fashion using automated manufacturing equipment. The above-described assembly processes may be performed using a combination of manual and automated processes. For example, the spout and bag assembly 202 and the neck support member 30 as shown in FIG. 20 may each be automatically fed into position relative to the outer shell 190 as shown in FIG. 20. The spout and bag assembly 202 and the neck support member 130 may then be automatically advanced toward each other until they are interconnected to each other and the sloped front panel 42 of the outer shell as shown in FIG. 13. Cardboard box folding and assembling equipment known to those skilled in the art may then perform the subsequent folding and adhesive dispensing operations in an automated manner. Furthermore, automated handling and shrink-wrapping equipment may be used so that the subsequent packaging and shrink-wrapping step may also be accomplished in an automated manner. The specific order of assembly, including the folding sequence and application of adhesive, may occur in any appropriate sequence and may be different than the described exemplary sequence.

For an end user to assemble the shrink wrapped container 180 of FIG. 21, the first step is to remove the shrink wrapping from the shrink wrapped container and set aside the pouring spout member 30. The user may then blow into the spout 131, forcing air into the expandable bag 203. As the expandable bag 203 expands, the container 180 expands to a generally rectangular shape, such as illustrated in FIG. 18. The user than inserts each of the tabs attached to the corners, 198*a*, 198*b*, 188, and 189 into its respective hole. For example, in FIG. 18, tab 188 has been inserted into hole 183. As shown in FIG. 18, the tabs, such as tab 189 are wider than their corresponding holes, such as hole 184. In this regard, once the tab 189 is inserted into hole 184, the tab 189 will be locked into place. This arrangement also produces robust corner sections since the 90-degree bend between the end flaps and the side sections (e.g., end flap 181 and side section 179*a*) may form a column of material resistant to bending along the side panel fold lines 197*a* and 197*b*. After the container 180 is assembled, it may be filled, the pouring spout member 30 may be attached and fluid dispensed as previously described.

Figure 22:
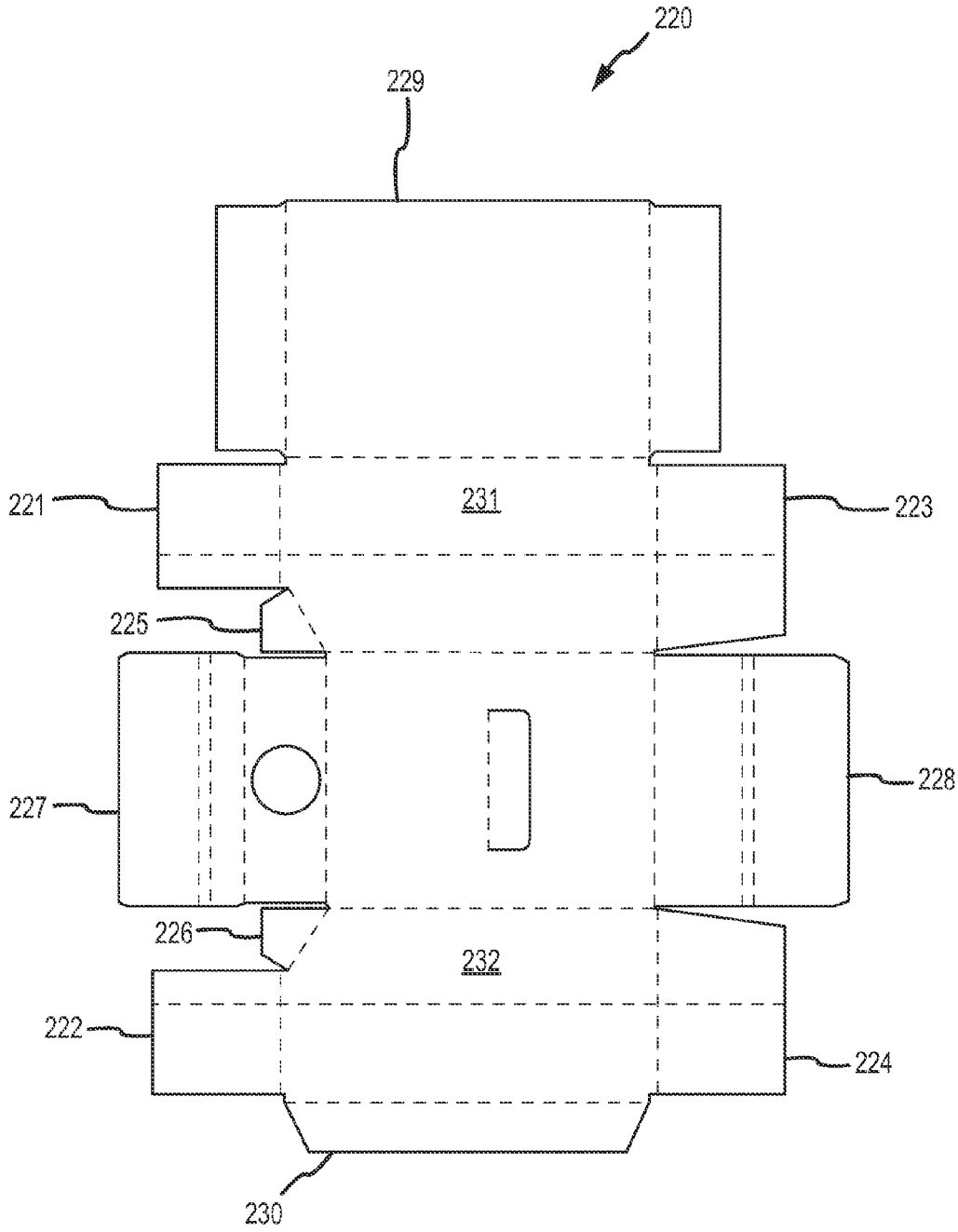
FIG. 22 illustrates an unfolded outer shell used for making the assembled container of FIG. 27.
Figure 27:
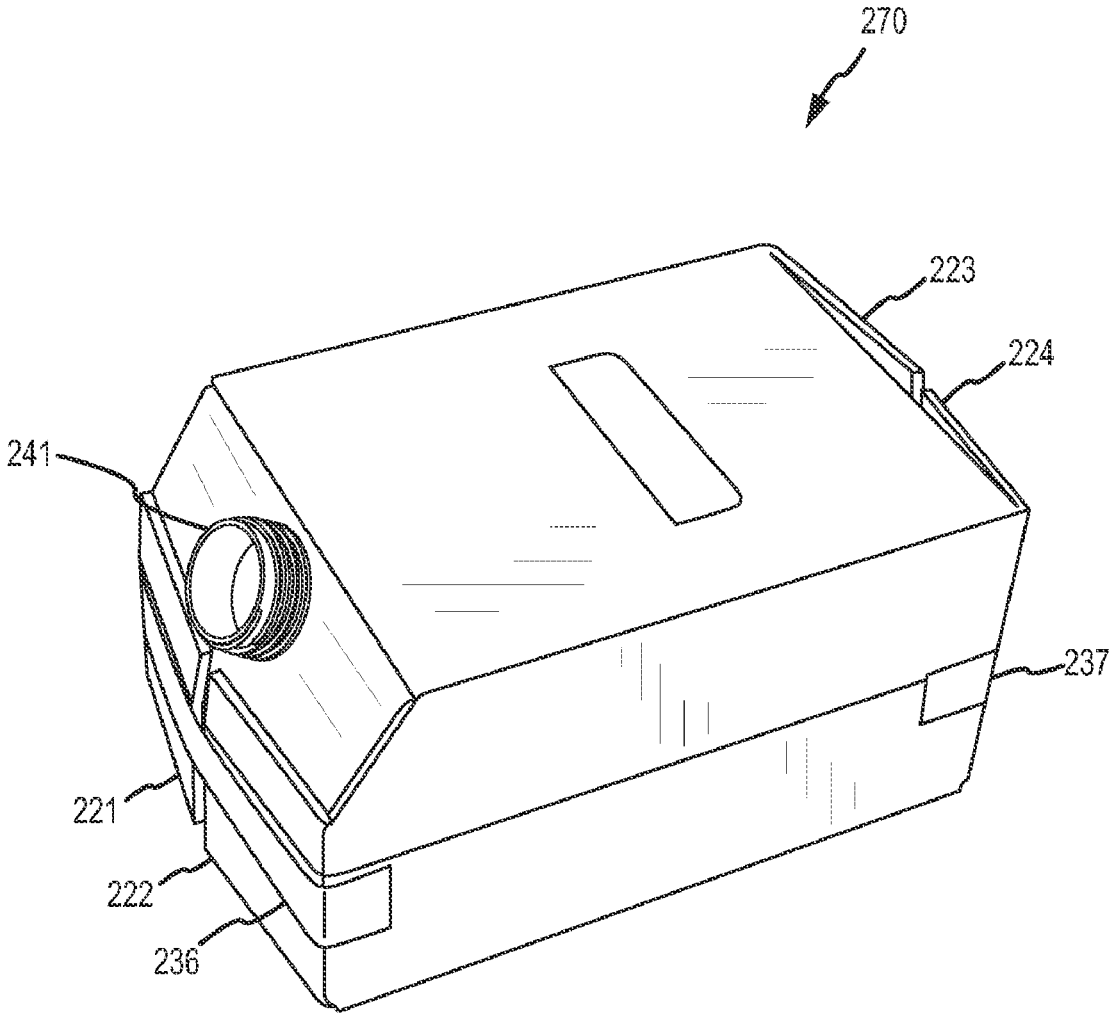
FIG. 27 illustrates a perspective view of the embodiment of the outer shell of FIG. 22 in an assembled configuration.

FIG. 22 is an illustration of an alternate embodiment of an outer shell 220 (in an unfolded state) that may be folded and assembled to produce a container 270 of FIG. 27. Many of the features of the outer shell 220 are similar to features of the pre-cut cardboard sheet 35 of FIG. 2, the outer shell 160 of FIG. 16, and the outer shell 190 of FIG. 19 and therefore will not be discussed with reference to the outer shell 220. The outer shell 220 may not contain any tabs to be inserted (such as tabs 188, 189, 198*a*, 198*b* of FIG. 19) during the assembly process. The outer shell 220 may include four support panels: a front left support panel 221, a front right support panel 222, a rear left support panel 223 and a rear right support panel 224. As will be described below, these support panels are operable to be easily folded about the glued and expanded container to form the container 270 of FIG. 27. The outer shell 220 may also include a left sloped front panel support tab 225 and a right front panel support tab 226. The outer shell 220 may also include a front panel 227, a rear panel 228, a bottom panel 229, and a tab 230. Furthermore, the outer shell 220 may also include a left side panel 231 and a right side panel 232. The terms left and right used herein are merely used to distinguish sides of the assembled container 270 from one another.

Figure 23:
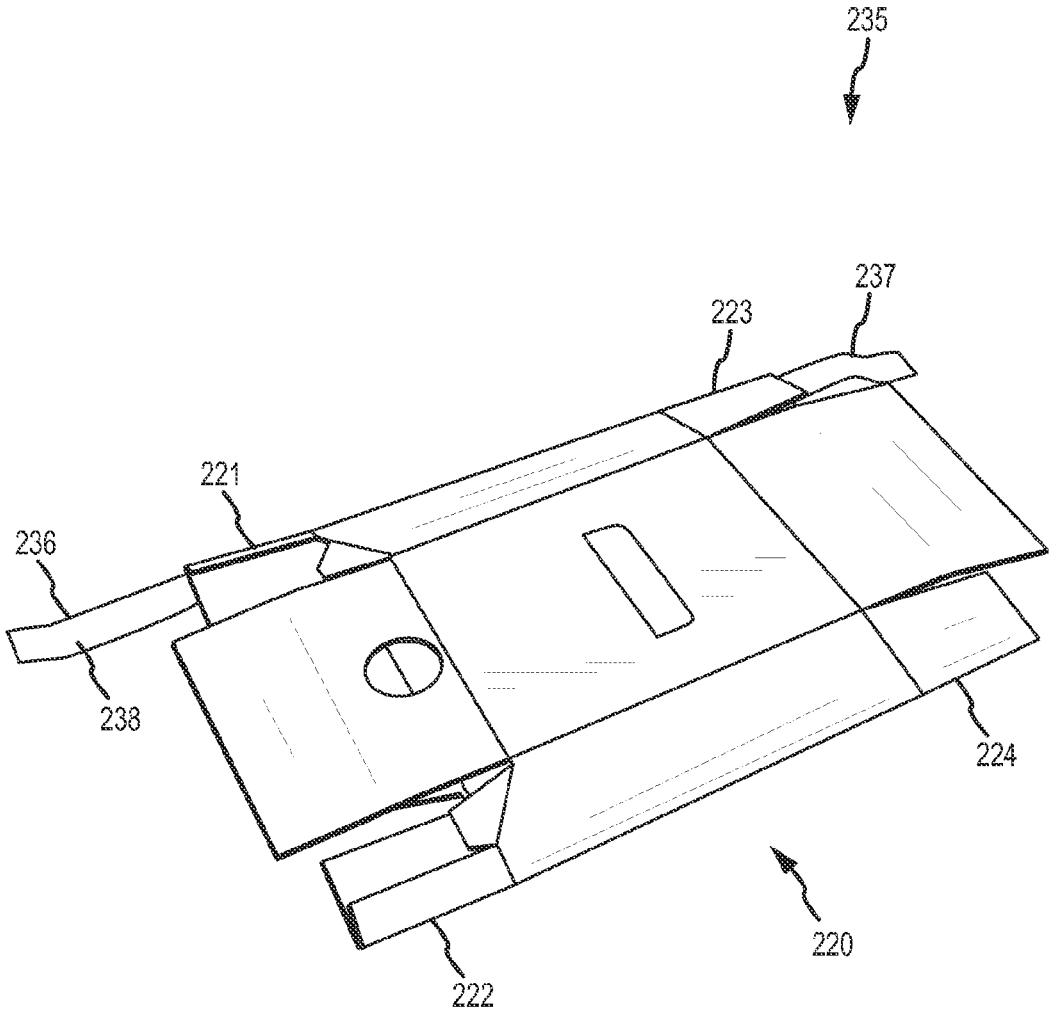
FIG. 23 illustrates a perspective view of the embodiment of the outer shell of FIG. 22 folded into a tube.

The outer shell 220 may be folded and glued to produce the intermediate configuration 235 as illustrated in FIG. 23. This may be achieved by placing an appropriate adhesive on the tab 230 and folding along the fold lines located midway through the left side panel 231 and the right side of 232 such that the tab 230 comes into contact with, and adhesively joins to, the bottom panel 229. Alternatively, the bottom panel may be split into two larger sections as in the embodiments illustrated in FIGS. 16 and 19. Alternatively, the side panels 231, 232 may be folded inward such that they are folded along the fold lines midway through the side panels 231, 232, but in the opposite directions as shown in FIG. 23. Furthermore, such folding will also require the side panels 231, 232 to be folded relative to the top panel 242 and bottom panel 229.

As illustrated in FIG. 23, a front interconnection member 236 and a rear interconnection member 237 may be attached to the outer shell 220. The front and rear interconnection members 236, 237 are illustrated attached to the front and rear left support panels 221 and 223, respectively. However, the front interconnection member 236 may be attached either to the front left support panel 221 or the front right support panel 222. In another embodiment, multiple front interconnection members 236 may be connected to both the front left support panel 221 and the front right support panel 222. The rear interconnection member may similarly be attached either to the rear left support panel 223 or the rear right support panel 224. Also, multiple rear interconnection members 237 may be connected to any or all of the support panels.

The front interconnection member 236 may be constructed from a single piece of adhesively backed tape. A first portion of the front interconnection member 236 may be adhesively joined to, for example, the front left support panel 221 as shown in FIG. 23. The remaining portion of the front interconnection member 236 that is shown not connected to the front left support panel 221 in FIG. 23 may include a removable backing 238. This removable backing 238 may protect the adhesive portion of the front interconnection member 236 not connected to the front left support panel 221 from being unintentionally adhesively joined during the manufacturing, storage, and assembly processes. Only when the removable backing 238 is removed from the front interconnection member 236 may that portion of the removable backing 238 be adhesively joined to another panel (e.g., front right support panel 222).

Other appropriate members that are capable of interconnecting panels may be used in place of the illustrated interconnection members 236, 237. For example, hook and loop fasteners (e.g., Velcro™) along with appropriately placed corresponding mating portions may be used in place of or in addition to the illustrated interconnection members 236, 237. For another example, an adhesive may be applied directly to one of the support panels and a removable member may be placed over the adhesive such that the adhesive is protected until the removable member is removed. During subsequent assembly, the removable member may be removed and the panel with the adhesive may be adhesively joined to another appropriate panel (e.g., a corresponding support panel and/or an end panel).

Figure 24:
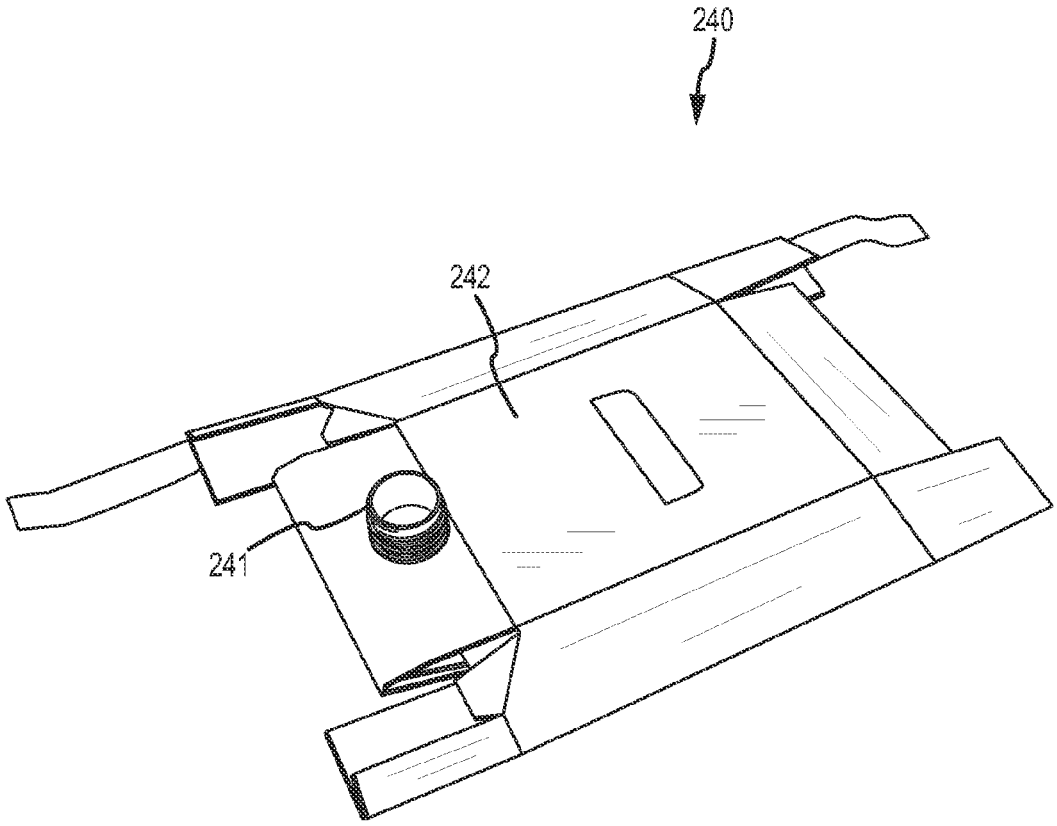
FIG. 24 illustrates a perspective view of the embodiment of the outer shell of FIG. 22 where the top and bottom panels are interconnected via side and end panels.

After the intermediate configuration 235 is formed, the next step may be to interconnect a spout and bag assembly 241 to the intermediate configuration 235. The spout and bag assembly 241 may include features of any of the above-described spout and support member embodiments. Alternatively, the spout and bag assembly 241 may be attached to the outer shell 220 prior to its folding into the intermediate configuration 235. Once the spout and bag assembly 241 has been inserted into the intermediate configuration 235, the front panel 227 and the rear panel 228 may be folded over and glued to corresponding tabs connected to the bottom panel 229 to form the intermediate configuration 240 illustrated in FIG. 24.

Figure 26:
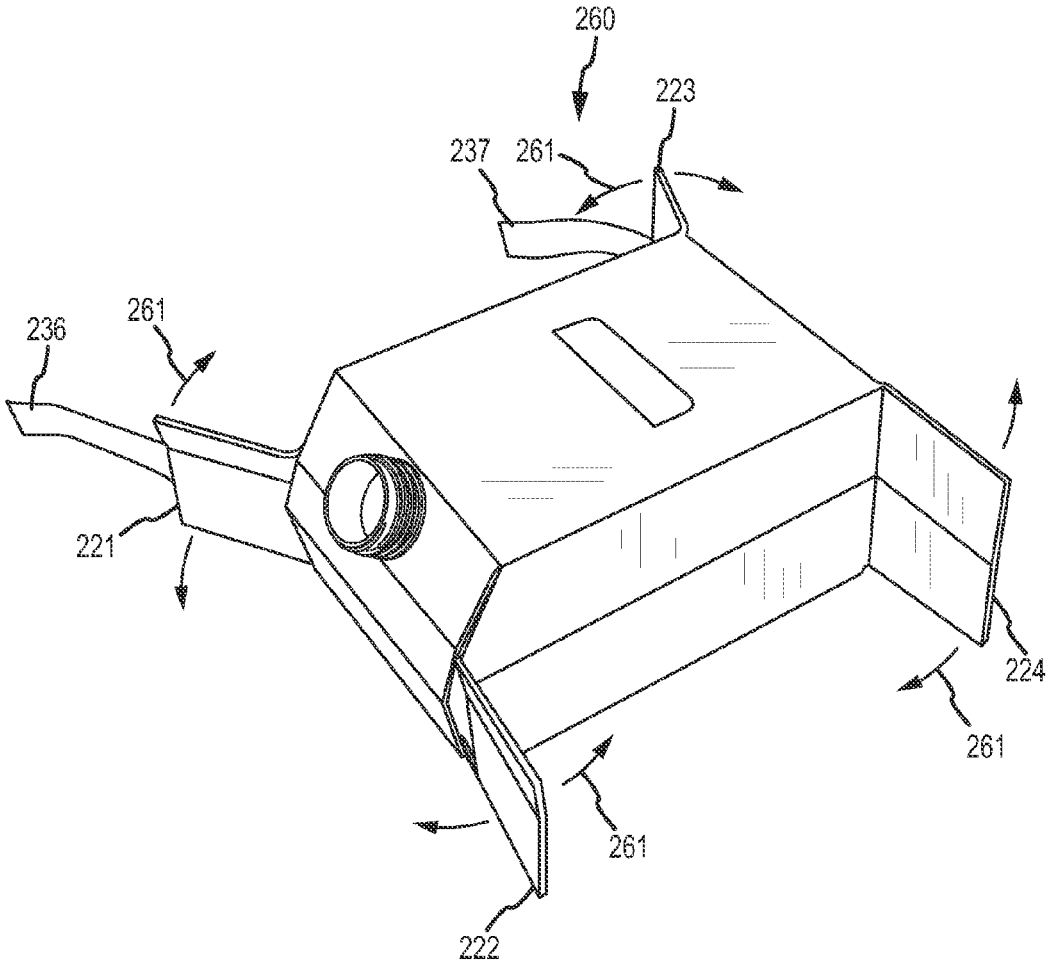
FIG. 26 illustrates a perspective view of the embodiment of the outer shell of FIG. 22 in an expanded configuration.

The next step may be to attach a source of pressurized gas to the spout and bag assembly 241 and inject gas into the intermediate configuration 240. The source of pressurized gas may, for example, be an industrial vacuum cleaner set to reverse with the end of the vacuum hose aligned with the spout of the spout and bag assembly 241, thus blowing air into the bag. This may result in the bag of the spout and bag assembly 241 expanding and causing the container to expand (e.g. to cause the top panel 242 to move away from the bottom panel 229) thus producing the expanded intermediate configuration 260 illustrated in FIG. 26. As the intermediate configuration 240 is expanded, the left sloped front panel support tab 225 and the right sloped front panel support tab 226 may be positioned such that they are disposed behind the front panel 227 as illustrated in FIG. 26.

At this point in the process, the bag of the spout and bag assembly 241 may be at least partially pressed up against the inner side of two or more of the panels (top panel 242, bottom panel 229, left side panel 231, right side panel 232, front panel 227, and rear panel 228). This may, in part, be due to the size of the bag when inflated being as large or larger than a corresponding cross dimension of the container when expanded.

The next step may be to fold each of the support panels 221, 222, 223, and 224 in the direction of folding arrows 261 such that the support panels 221, 222, 223, and 224 are disposed against their corresponding side panels. This may be followed by collapsing the expanded intermediate configuration 260 such that the support panels 221, 222, 223, and 224 fold inward with their respective side panels to form the collapsed container 250 illustrated in FIG. 25.

The expansion and collapsing of the bag in this manner may yield an improved ability to assemble the container later on by an end user. For example, the bag may be supplied as a flattened bag containing little or no air. Without the expansion of the bag, the flattened bag may tend to stay flattened during later user assembly.

Figure 25:
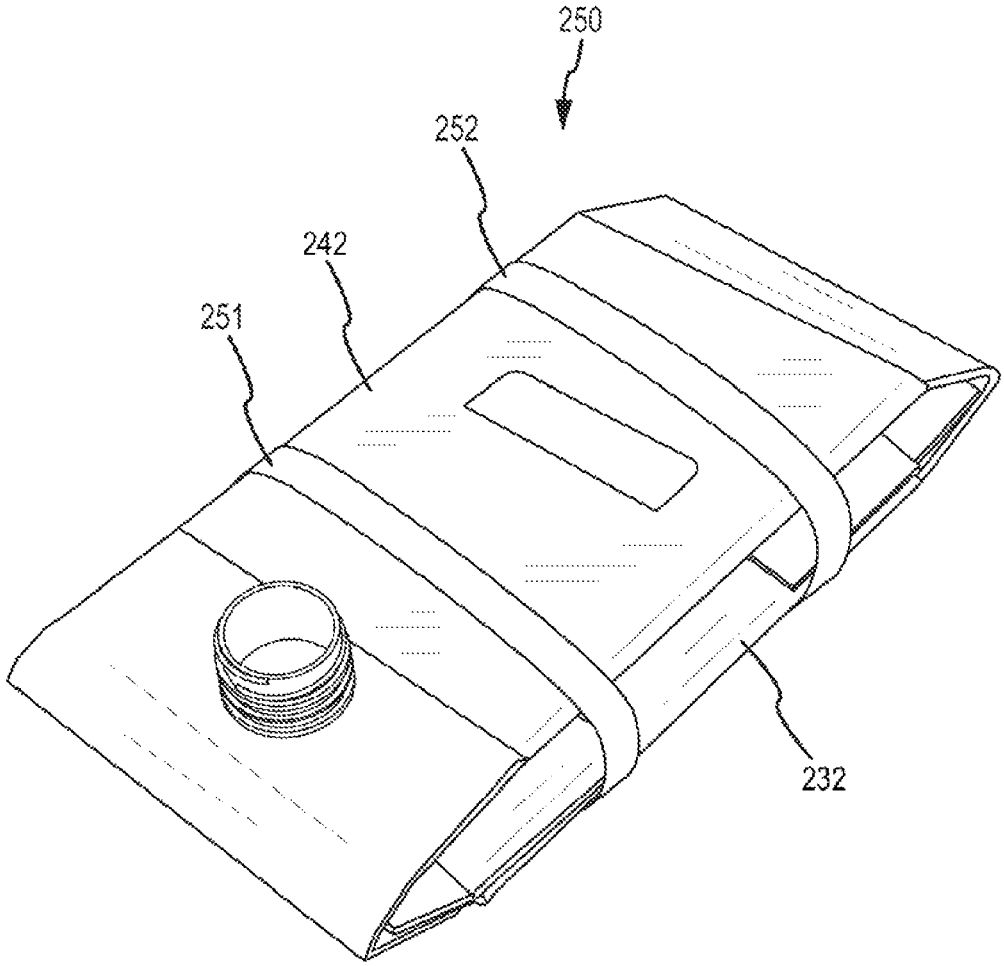
FIG. 25 illustrates a perspective view of the embodiment of the outer shell of FIG. 22 in a collapsed configuration.

As illustrated in the collapsed state of FIG. 25, the lower portions of the side panels (e.g., side panel 232) are disposed proximate to the bottom panel 229 (not visible in FIG. 25) and upper portions of the side panels are disposed proximate to the upper panel 242. Without the expansion of the bag, the flattened bag may, for example, tend to occupy an area above the side panel 232 (sandwiched between the side panel 232 and the top panel 242) or below the side panel 232 (sandwiched between the side panel 232 and the bottom panel 229), but not both areas.

In contrast, with the expansion of the bag, the bag may be pressed against the internal sides of the various panels, and when the container is collapsed as shown in FIG. 25, a first portion of the bag may occupy a portion above the side panel 232 (sandwiched between the side panel 232 and the top panel 242) and a second portion of the bag may occupy a portion below the side panel 232 (sandwiched between the side panel 232 and the bottom panel 229). Such positioning may be advantageous over the previously described positioning (where the bag remains flattened) since during subsequent expansion by an end user, the bag may be more evenly distributed throughout the interior volume of the assembled container 270. This may reduce the possibility of the bag binding during filling and may in addition or alternatively yield an affinity between the bag and the internal sides of the various panels, further facilitating bag expansion during user assembly.

Returning to FIG. 25, securing members 251, 252 may be wrapped around the collapsed container 250 to prevent the collapsed container 250 from unwanted expansion during subsequent handling. The collapsed container 250 may then be shrink-wrapped (shrink-wrap not shown). Flattening the collapsed container 250 advantageously reduces the volume of space taken up by the collapsed container 250 when it is not being used to store and/or transport liquids. This is beneficial since the collapsed container 250 takes up less volume in storage and shipping than an expanded container. The configuration of the collapsed container 250 is also beneficial to retailers since the collapsed container 250 will take up less shelf space and to consumers since the collapsed container 250 will take up less interior space (e.g., within a vehicle). After the collapsed container 250 is shrink-wrapped, the securing members 251, 252 may be cut or broken so that they are no longer preventing the collapsed container 250 from expanding. However, at this point the shrink-wrap may continue to prevent the collapsed container 250 from expanding. In this regard, an end-user who desires to use the collapsed container 250 will only need to remove the shrink wrap from the collapsed container 250 and will not need to cut or break the securing members 251, 252 before expanding the collapsed container 250.

An end-user who desires to use the collapsed container 250 to transport liquids may remove the shrink-wrap from the collapsed container 250. The collapsed container 250 may, after removal of the shrink-wrap, at least partially expand on its own due to the mechanical memory of the outer shell 220 and the spout and bag assembly 241. The end-user may complete the expansion process by, for example, pressing the front panel 227 and rear panel 228 toward each other thereby expanding the container to the expanded intermediate configuration 260 illustrated in FIG. 26. This expansion may also tend to cause the support panels 221, 222, 223, and 224 to move away from their corresponding side panels generally toward a position such as that illustrated in FIG. 26. At this point in the process the bag of the spout and bag assembly 241 may generally be positioned along the various panels (e.g., the bag may not remain in a fully collapsed state within the expanded intermediate configuration 260).

The end-user may now fold the various support panels to form the assembled container 270 illustrated in FIG. 27. This may include folding the front right support panel 222 against the front panel 227 and then folding the front left support panel 221 against the front half 227, then removing the removable backing 238 from the front interconnection member 236 and securing the side of the front interconnection member 236 with the exposed adhesive to the front right support panel 222 as shown in FIG. 27. A similar process may be used to secure the rear right support panel 224 and the rear left support panel 223 to the position shown in FIG. 27. The precise order of the above-described steps of securing the support panels may be varied as appropriate. For example the end-user may, as a first step, remove the removable backing 238 from the front interconnection member 236 and then go on to fold the front right support panel 222 and front left support panel 221. Once assembly of the assembled container 270 is complete, the container may be used (e.g., filled with liquid, transported, to dispense liquid) in a manner similar to that of any appropriate embodiment described herein or in any other appropriate manner.

The various secured support panels in the positions illustrated in FIG. 27 may provide exceptional columnar strength at the corners of the assembled container. This is by virtue of the side panels and support panels forming continuous portions of materials disposed at 90° from each other at the corners. In addition, the left sloped front panel support tab 225 and the right sloped front panel support tab 226, positioned behind the front panel 227 as illustrated in FIG. 27 may provide additional support to counteract forces placed on the spout of the spout and bag assembly 241 during fluid insertion and dispensing, and other handling of the assembled container 270.

While in FIGS. 22 through 27, the support panels are illustrated directly connected to the side panels, other appropriate configurations may be used. For example, the support panels may be directly connected to the end panels, or some support panels may be directly connected to the end panels while others may be directly connected to the side panels.

While the invention has been illustrated and described in detail in the drawings and foregoing description, such illustration and description is to be considered as exemplary and not restrictive in character. For example, certain embodiments described hereinabove may be combinable with other described embodiments and/or arranged in other ways (e.g., process elements may be performed in other sequences). Accordingly, it should be understood that only exemplary embodiments and variants thereof have been shown and described and that all changes and modifications that come within the spirit of the invention are desired to be protected.

What is claimed is:

1. A collapsible container for storing liquid comprising:

an outer shell;

a spout interconnected to said outer shell;

an expandable bag located inside of said outer shell, wherein said expandable bag is fluidly interconnected to said spout;

wherein said outer shell includes a top panel and a bottom panel, wherein said top panel and bottom panel are interconnected to each other by a first side panel, wherein said top panel and bottom panel are interconnected to each other by a second side panel, wherein said first side panel is oppositely disposed from said second side panel, wherein said top panel and bottom panel are interconnected to each other by a first end panel, wherein said interconnections between said top panel and bottom panel by said first and second side panels and said first end panel are each operable to be maintained during expansion of said collapsible container from a collapsed state to an expanded state a first support panel connected to one of said first side panel and said first end panel; and an interconnection member operable to interconnect said first support panel to another panel of said outer shell.

2. The collapsible container according to claim 1, wherein in an uncollapsed state, said outer shell is in the form of a rectangular-shaped box.

3. The collapsible container according to claim 1, wherein said expandable bag comprises a dual-layered liner.

4. The collapsible container according to claim 3, wherein said dual-layered liner comprises:

an inner liner comprising a multi-polymer laminate; and an outer liner comprising a nylon laminate, wherein said inner liner is fixedly attached to said outer liner.

5. The collapsible container according to claim 1, wherein said outer shell comprises cardboard.

6. The collapsible container according to claim 1, wherein said another panel of said outer shell is an oppositely disposed second support panel.

7. The collapsible container according to claim 1, wherein said spout is interconnected to said first end panel, wherein said first support panel is connected to said first side panel at an end of said first side panel opposite from said first end panel.

8. The collapsible container according to claim 1, wherein said first support panel is operable to spring out relative to the panel to which it is connected when said collapsible container is expanded from said collapsed state.

9. The collapsible container according to claim 1, wherein in said collapsed state, said collapsible container is folded substantially flat.

10. The collapsible container according to claim 1, wherein said outer shell is folded to form a rectangular box.

11. The collapsible container according to claim 1, wherein said top panel and bottom panel are interconnected to each other by a second end panel, wherein said first end panel is oppositely disposed from said second end panel.

* * * * *